US009370706B2

(12) United States Patent
Prassler et al.

(10) Patent No.: US 9,370,706 B2
(45) Date of Patent: Jun. 21, 2016

(54) MOVING TRAINING DEVICE WITH SPEED CONTROLLED ACCORDING TO A PHYSIOLOGICAL PARAMETER OF THE USER

(75) Inventors: Erwin Prassler, Landsberg (DE); Walter Nowak, Bochum (DE); Sebastian Blumenthal, Stuttgart (DE); Alexey Zakharov, Tuebingen (DE); Thilo Zimmermann, Stuttgart (DE)

(73) Assignee: Locomotec US (Haftungsbeschrankt) (DE)

( * ) Notice: Subject to any disclaimer, the term of this patent is extended or adjusted under 35 U.S.C. 154(b) by 155 days.

(21) Appl. No.: 14/126,133

(22) PCT Filed: Jun. 13, 2012

(86) PCT No.: PCT/EP2012/061199

§ 371 (c)(1),
(2), (4) Date: Mar. 10, 2014

(87) PCT Pub. No.: WO2012/171956

PCT Pub. Date: Dec. 20, 2012

(65) Prior Publication Data

US 2015/0025660 A1 Jan. 22, 2015

(30) Foreign Application Priority Data

Jun. 14, 2011 (DE) ..... 10 2011 051 054

(51) Int. Cl.

| | |
|---|---|
| ***A63F 9/24*** | (2006.01) |
| ***A63B 71/06*** | (2006.01) |
| ***A63B 21/06*** | (2006.01) |

(Continued)

(52) U.S. Cl.

CPC ..... *A63B 71/0619* (2013.01); *A63B 21/0615* (2013.01); *A63B 23/047* (2013.01); *A63B 24/0062* (2013.01); *A63B 69/0028* (2013.01); *A63B 2230/045* (2013.01); *A63B 2230/085* (2013.01); *A63B 2230/201* (2013.01); *A63B 2230/203* (2013.01); *A63B 2230/305* (2013.01); *A63B 2230/405* (2013.01); *A63B 2230/425* (2013.01); *A63B 2230/431* (2013.01); *A63B 2230/505* (2013.01); *A63B 2230/705* (2013.01); *A63B 2230/755* (2013.01)

(58) Field of Classification Search

CPC ..... A63B 2230/06; A63B 2220/30; A63B 69/0028; A63B 2024/0065; A63B 2230/30; A63B 22/0235; A63B 2230/425; A63B 22/0242; A63B 71/0619

See application file for complete search history.

(56) References Cited

U.S. PATENT DOCUMENTS

| | | | | |
|---|---|---|---|---|
| 3,518,985 | A * | 7/1970 | Quinton | 600/520 |
| 4,334,677 | A * | 6/1982 | Tata | 482/14 |

(Continued)

FOREIGN PATENT DOCUMENTS

| | | |
|---|---|---|
| DE | 10318929 | 8/2004 |
| DE | 202004010543 | 9/2004 |

(Continued)

*Primary Examiner* — Steve Rowland
(74) *Attorney, Agent, or Firm* — Barnes & Thornburg LLP

(57) ABSTRACT

The invention relates to a training device, which can comprise a drive that can be configured for the locomotion of the training device and a control circuit that can comprise an interface configured for receiving a physiological parameter of a user of the training device. The control circuit can be configured to specify a speed of the drive based on the received physiological parameter.

15 Claims, 21 Drawing Sheets

(51) Int. Cl.

| | |
|---|---|
| ***A63B 23/04*** | (2006.01) |
| ***A63B 24/00*** | (2006.01) |
| ***A63B 69/00*** | (2006.01) |

(56) References Cited

U.S. PATENT DOCUMENTS

| | | | | |
|---|---|---|---|---|
| 5,462,504 | A * | 10/1995 | Trulaske et al. | 482/7 |
| 5,879,270 | A * | 3/1999 | Huish et al. | 482/8 |
| 6,188,957 | B1 * | 2/2001 | Bechtolsheim et al. | 701/446 |
| 6,458,060 | B1 * | 10/2002 | Watterson et al. | 482/54 |
| 2005/0272572 | A1 | 12/2005 | Lewis | |
| 2007/0270719 | A1 * | 11/2007 | Jwo | 600/587 |
| 2011/0218076 | A1 * | 9/2011 | Lawrence | 482/4 |

FOREIGN PATENT DOCUMENTS

| | | |
|---|---|---|
| DE | 102006024019 | 11/2007 |
| DE | 102009005974 | 8/2010 |
| WO | WO02/067449 | 8/2002 |
| WO | WO2011/039722 | 4/2011 |

* cited by examiner

1300

1400

1900

2100

2300

2400

MOVING TRAINING DEVICE WITH SPEED CONTROLLED ACCORDING TO A PHYSIOLOGICAL PARAMETER OF THE USER

Various embodiments relate to training devices, attachment sets, control circuits and methods for controlling the training device.

Ergometers are widely used training devices that serve the purpose of increasing the fitness of a person and improving the resilience and endurance of the cardiovascular system of a person. They are used not only in rehabilitation medicine but also in the private sector or amateur sport and also in professional sport.

Common types of ergometers are bicycle ergometers, treadmill ergometers or rowing ergometers. Ergometers are typically fixed in place and set up indoors, for example in fitness studios, sports halls or fitness rooms.

Targeted outdoor training is performed either with a heart rate monitor, which indicates a departure from the ideal training range by emitting alarm signals, or by using a professional running trainer, who runs ahead at a controlled speed as a pacemaker for the person undergoing the training.

The invention addresses the problem of providing a training device that enables the user to engage in good outdoor running training that is appropriate for the physical fitness and goals of the user even without a professional running trainer.

The problem is solved by methods, training devices, attachment sets for training devices and control circuits with the features according to the independent patent claims.

Developments are provided by the dependent claims.

According to an embodiment, a training device may include a drive, designed for the advancement of the training device, and a control circuit, which may include an interface configured to receive a physiological parameter of a user of the training device. The control circuit may be configured to specify a speed of the drive on the basis of the psychological parameter received.

In one embodiment, the control circuit may also be configured to activate the drive according to the specified speed.

In one embodiment, the drive may include wheels.

In one embodiment, the drive may include chains and/or crawlers.

In one embodiment, the drive may include legs.

In one embodiment, the drive may include a means for changing a direction of advancement of the training device.

In one embodiment, the control circuit may also be configured to control a specified direction of the training device by means of the means for changing the direction of advancement.

In one embodiment, the control circuit may also be configured to reduce the specified speed on the basis of a rate of the change of the direction of advancement.

In one embodiment, the training device may also include a GPS signal-receiving circuit, which may be configured to receive a GPS signal.

In one embodiment, the control circuit may also be configured to control the specified direction of the training device on the basis of the GPS signal received.

The training device may also include a direction sensor, which may be configured to determine an orientation of the training device.

In one embodiment, the direction sensor may include or be a gyroscope and/or an acceleration sensor and/or a compass.

In one embodiment, the control circuit may also be configured to control the specified direction of the training device on the basis of the orientation determined.

In one embodiment, the control circuit may also be configured to specify a specified path of the training device.

In one embodiment, the control circuit may also be configured to activate the drive and for activating the means for changing the direction of advancement of the training device according to the specified path.

In one embodiment, the training device may also include a distance sensor, which may be configured to determine a distance of the training device from an obstacle.

In one embodiment, the control circuit may also be configured to specify a reduction in the speed of the drive on the basis of a specified condition for the distance determined.

In one embodiment, the training device may also include an emergency-off switch, which may be configured to determine a hazardous situation. A hazardous situation may be determined for example by a removal of the clip and associated activation of an emergency off.

In one embodiment, the control circuit may also be configured to specify a reduction in the speed of the drive on the basis of a specified condition for the hazardous situation determined.

In one embodiment, the training device may also include a sensor, which may be configured to determine the at least one physiological parameter and for transmitting the physiological parameter determined to the control circuit via the interface.

In one embodiment, the at least one physiological parameter may include or be a heart rate of a user of the training device and/or a respiration rate of a user of the training device and/or an oxygen saturation of a user of the training device and/or a skin conductivity of a user of the training device and/or a body temperature of a user of the training device and/or a blood pressure of a user of the training device and/or an energy consumption of a user of the training device.

In one embodiment, the control circuit may also be configured to increase the specified speed on the basis of a first specified condition for the physiological parameter received and for reducing the specified speed on the basis of a second specified condition for the physiological parameter received.

In one embodiment, the control circuit may also be configured to specify the speed such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the control circuit may also be configured to specify the speed on the basis of a continuing training time.

In one embodiment, the control circuit may also be configured to specify the speed on the basis of a training distance covered.

In one embodiment, the control circuit may also be configured to specify the speed on the basis of a current position of the training device.

In one embodiment, the training device may also include a user-input circuit, which may be configured to receive a user input. The control circuit may also be configured to specify the speed on the basis of the user input received.

In one embodiment, an attachment set for a training device may include a drive, configured to advance the training device, a fastening means, configured to fasten the drive to the training device, and a control circuit, including an interface configured to receive a physiological parameter of a user of the training device. The control circuit may be configured to specify a speed of the drive on the basis of the physiological parameter received. It will be understood that the wording "attachment set for training device" and the following use of the term "training device" also cover the case where the attachment set is fitted to an existing vehicle, for example to a customary children's, buggy, and in this way a vehicle is made into a training device. The attachment set may be part of the modular device configuration described further below.

In one embodiment, the control circuit may also be configured to activate the drive according to the specified speed.

In one embodiment, the drive may include wheels.

In one embodiment, the drive may include chains and/or crawlers.

In one embodiment, the drive may include legs.

In one embodiment, the drive may include a means for changing a direction of advancement of the training device.

In one embodiment, the control circuit may also be configured to control a specified direction of the training device by means of the means for changing the direction of advancement.

In one embodiment, the control circuit may also be configured to reduce the specified speed on the basis of a rate of the change of the direction of advancement.

In one, embodiment, the attachment set may also include a GPS signal-receiving circuit, which may be configured to receive a GPS signal.

In one embodiment, the control circuit may also be configured to control the specified direction of the training device on the basis of the GPS signal received.

In one embodiment, the attachment set may also include a direction sensor, which may be configured to determine an orientation of the training device.

In one embodiment, the direction sensor may be or include a gyroscope and/or an acceleration sensor and/or a compass.

In one embodiment, the control circuit may also be configured to control the specified direction of the training device on the basis of the orientation determined.

In one embodiment, the control circuit may also be configured to specify a specified path of the training device.

In one embodiment, the control circuit may also be configured to activate the drive and for activating the means for changing the direction of advancement of the training device according to the specified path.

In one embodiment, the attachment set may also include a distance sensor, which may be configured to determine a distance of the training device from an obstacle.

In one embodiment, the control circuit may also be configured to specify a reduction in the speed of the drive on the basis of a specified condition for the distance determined.

In one embodiment, the attachment set may also include an emergency-off switch, which may be configured to determine a hazardous situation.

In one embodiment, the control circuit may also be configured to specify a reduction in the speed of the drive on the basis of a specified condition for the hazardous situation determined.

In one embodiment, the attachment set may also include a sensor, which may be configured to determine the at least one physiological parameter and for transmitting the physiological parameter determined to the control circuit via the interface.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the control circuit may also be configured to increase the specified speed on the basis of a first specified condition for the physiological parameter received and for reducing the specified speed on the basis of a second specified condition for the physiological parameter received.

In one embodiment, the control circuit may also be configured to specify the speed such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the control circuit may also be configured to specify the speed on the basis of a continuing training time.

In one embodiment, the control circuit may also be configured to specify the speed on the basis of a training distance covered.

In one embodiment, the control circuit may also be configured to specify the speed on the basis of a current position of the training device.

In one embodiment, the attachment set may also include a user-input circuit, which may be configured to receive a user input. The control circuit may also be configured to specify the speed on the basis of the user input received.

In one embodiment, a control circuit for controlling a training device may include an interface, which may be configured to receive a physiological parameter of a user of the control circuit. The control circuit may be configured to specify a speed of advancement of the training device on the basis of the physiological parameter received.

In one embodiment, the control circuit may also be configured to activate a drive of the training device according to the specified speed.

In one embodiment, the control circuit may also be configured to control a specified direction of the training device by means of a means for changing the direction of advancement of the training device.

In one embodiment, the control circuit may also be configured to reduce the specified speed on the basis of a rate of the change of the direction of advancement.

In one embodiment, the control circuit may also include a GPS signal-receiving circuit, which may be configured to receive a GPS signal.

In one embodiment, the control circuit may also be configured to control the specified direction of the training device on the basis of the GPS signal received.

In one embodiment, the control circuit may also include a direction sensor, which may be configured to determine an orientation of the training device.

In one embodiment, the direction sensor may include or be a gyroscope and/or an acceleration sensor and/or a compass.

In one embodiment, the control circuit may also be configured to control the specified direction of the training device on the basis of the orientation determined.

In one embodiment, the control circuit may also be configured to specify a specified path of the training device.

In one embodiment, the control circuit may also be configured to activate the drive and for activating the means for changing the direction of advancement of the training device according to the specified path.

In one embodiment, the control circuit may also include a distance sensor, which may be configured to determine a distance of the training device from an obstacle.

In one embodiment, the control circuit may also be configured to specify a reduction in the speed of the drive on the basis of a specified condition for the distance determined.

In one embodiment, the control circuit may also include an emergency-off switch, which may be configured to determine a hazardous situation.

In one embodiment, the control circuit may also be configured to specify a reduction in the speed of the drive on the basis of a specified condition for the hazardous situation determined.

In one embodiment, the control circuit may also include a sensor, which may be configured to determine the at least one physiological parameter and for transmitting the physiological parameter determined to the control circuit via the interface.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the control circuit may also be configured to increase the specified speed on the basis of a first specified condition for the physiological parameter received and for reducing the specified speed on the basis of a second specified condition for the physiological parameter received.

In one embodiment, the control circuit may also be configured to specify the speed in such a way that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the control circuit may also be configured to specify the speed on the basis of continuing training time.

In one embodiment, the control circuit may also be configured to specify the speed on the basis of a training distance covered.

In one embodiment, the control circuit may also be configured to specify the speed on the basis of a current position of the training device.

In one embodiment, the control circuit may also include a user-input circuit, which may be configured to receive a user input. The control circuit may also be configured to specify the speed on the basis of the user input received.

In one, embodiment, methods for controlling a training device may be provided. It may be that a physiological parameter of a user of the training device is received. It may be that a speed of a drive configured to advance the training device is specified on the basis of the physiological parameter received.

In one embodiment, the drive may be activated according to the specified speed.

In one embodiment, a specified direction of the training device may also be controlled by means of a means for changing the direction of advancement of the training device.

In one embodiment, the specified speed may also be reduced on the basis of a rate of the change of the direction of advancement.

In one embodiment, a GPS signal may also be received.

In one embodiment, the specified direction of the training device may also be controlled on the basis of the GPS signal received.

In one embodiment, an orientation the training device may also be determined.

In one embodiment, the specified direction of the training device may also be controlled on the basis of the orientation determined.

In one embodiment, a specified path of the training device may also be specified.

In one embodiment, the drive for changing the direction of advancement of the training device may also be activated according to the specified path.

In one embodiment, a distance of the training device from an obstacle may also be determined.

In one embodiment, a reduction in the speed of the drive may also be specified on the basis of a specified condition for the distance determined.

In one embodiment, a hazardous situation may also be determined.

In one embodiment, a reduction in the speed of the drive may also be specified on the basis of a specified condition for the hazardous situation determined.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the specified speed may also be increased on the basis of a first specified condition for the physiological parameter received and/or the specified speed may be reduced on the basis of a second specified condition for the physiological parameter received.

In one embodiment, the speed may also be specified such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the speed may also be specified on the basis of a continuing training time.

In one embodiment, the speed may also be specified on the basis of a training distance covered.

In one embodiment, the speed may also be specified on the basis of a current position of the training device.

In one embodiment, a user input may also be received and the speed specified on the basis of the user input received.

Embodiments of the invention are represented in the figures and are explained in more detail below.

Figure 1:
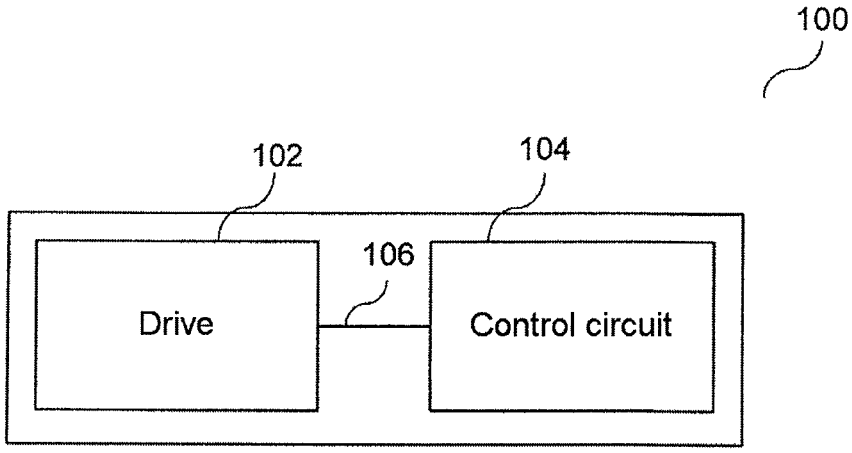
FIG. 1 shows a training device according to an embodiment.

FIG. 1 shows a training device 100 according to an embodiment. The training device 100 may include a drive 102, configured to advance the training device, and a control circuit 104, which may include an interface configured to receive a physiological parameter of a user of the training device. The control circuit 104 may be configured to specify a speed of the drive on the basis of the physiological parameter received. The drive 102 and the control circuit 104 may be connected to one another via a connection 106. The connection may, for example, be an electrical or optical connection, for example a cable or a bus.

In one embodiment, the control circuit 104 may also be configured to activate the drive according to the specified speed.

In one embodiment, the drive 102 may include wheels.

In one embodiment, the drive 102 may include chains and/or crawlers.

In one embodiment, the drive 102 may include legs.

In one embodiment, the drive 102 may include a means for changing a direction of advancement of the training device 100.

In one embodiment, the control circuit 104 may also be configured to control a specified direction of the training device 100 by means of the means for changing the direction of advancement.

In one embodiment, the control circuit 104 may also be configured to reduce the specified speed on the basis of a rate of the change of the direction of advancement.

In one embodiment, the training device 100 may also include a GPS signal-receiving circuit (not shown), which may be configured to receive a GPS signal.

In one embodiment, the control circuit 104 may also be configured to control the specified direction of the training device on the basis of the GPS signal received.

Figure 2:
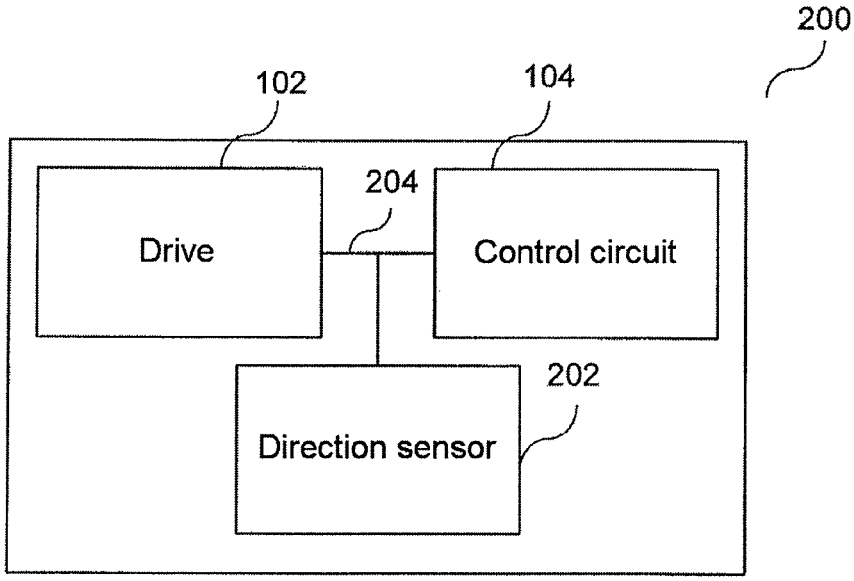
FIG. 2 shows a training device according to an embodiment.

FIG. 2 shows a training device 200 according to an embodiment. In a manner similar to the training device 100 shown in FIG. 1, the training device 200 may include a drive 102. In a manner similar to the training device 100 shown in FIG. 1, the training device 200 may include a control circuit 104. The training device 200 may also include a direction sensor 202, which may be configured to determine an orientation of the training device 200. The drive 102, the control circuit 104 and the direction sensor 202 may be connected to one another via a connection 204.

The connection may, for example, be an electrical or optical connection, for example a cable or a bus.

In one embodiment, the direction sensor 202 may include or be a gyroscope and/or an acceleration sensor and/or a compass.

In one embodiment, the control circuit 104 may also be configured to control the specified direction of the training device 200 on the basis of the orientation determined.

In one embodiment, the control circuit 104 may also be configured to specify a specified path of the training device 200.

In one embodiment, the control circuit 104 may also be configured to activate the drive 102 and for activating the means for changing the direction of advancement of the training device according to the specified path.

In one embodiment, the training device 200 may also include a distance sensor (not shown), which may be configured to determine a distance of the training device 200 from an obstacle.

In one embodiment, the control circuit 104 may also be configured to specify a reduction in the speed of the drive 102 on the basis of a specified condition for the distance determined.

In one embodiment, the training device 200 may also include an emergency-off switch (not shown), which may be configured to determine a hazardous situation.

In one embodiment, the control circuit 104 may also be configured to specify a reduction in the speed of the drive on the basis of a specified condition for the hazardous situation determined.

In one embodiment, the training device 200 may also include a sensor, which may be configured to determine the at least one physiological parameter and for transmitting the physiological parameter determined to the control circuit 104 via the interface.

In one embodiment, the at least one physiological parameter may include or be a heart rate of a user of the training device 200 and/or a respiration rate of user of the training device 200 and/or an oxygen saturation of a user of the training device 200 and/or a skin conductivity of a user of the training device 200 and/or a body temperature of a user of the training device 200 and/or a blood pressure of a user of the training device 200 and/or an energy consumption of user of the training device 200.

In one embodiment, the control circuit 104 may also be configured to increase the specified speed on the basis of a first specified condition for the physiological parameter received and for reducing the specified speed on the basis of a second specified condition for the physiological parameter received.

In one embodiment, the control circuit 104 may also be configured to specify the speed such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device 200.

In one embodiment, the control circuit may also be configured to specify the speed on the basis of a continuing training time.

In one embodiment, the control circuit 104 may also be configured to specify the speed on the basis of a training distance covered.

In one embodiment, the control circuit 104 may also be configured to specify the speed on the basis of a current position of the training device.

In one embodiment, the training device 200 may also include a user-input circuit (not shown), which may be configured to receive a user input. The control circuit 104 may also be configured to specify the speed on the basis of the user input received.

Figure 3:
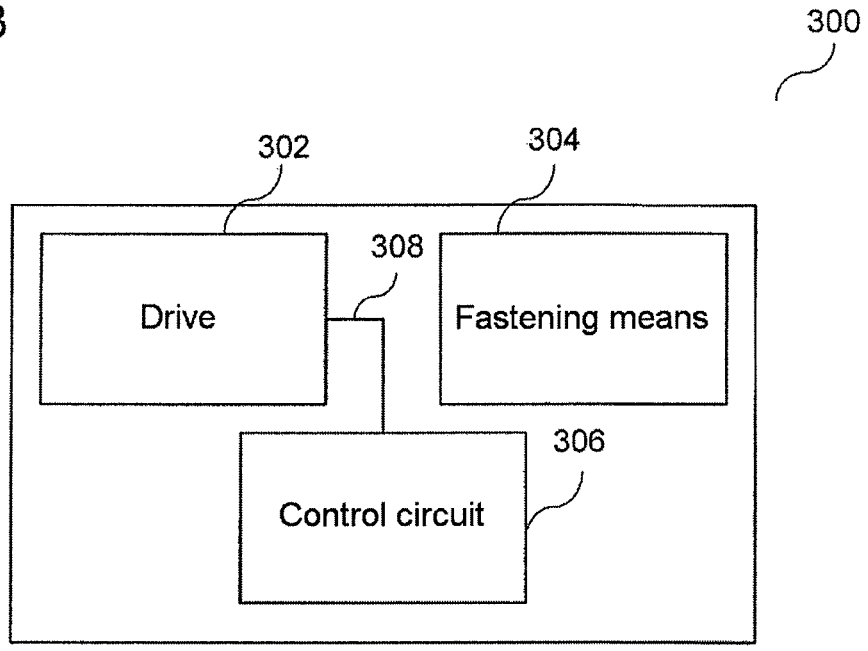
FIG. 3 shows an attachment set according to an embodiment.

FIG. 3 shows an attachment set 300 according to an embodiment. The attachment set 300 may be an attachment set for a training device and include a drive 302, configured to advance the training device, a fastening means 304, configured to fasten the drive 302 to the training device, and a control circuit 306, including an interface configured to receive a physiological parameter of a user of the training device. The control circuit 306 may be configured to specify a speed of the drive on the basis of the physiological parameter received. The drive 302 and the control circuit 306 may be connected to one another via a connection 308. The connection may be, for example, an electrical or optical connection, for example a cable or a bus.

In one embodiment, the control circuit 306 may also be configured to activate the drive 302 according to the specified speed.

In one embodiment, the drive 302 may include wheels.

In one embodiment, the drive 302 may include chains and/or crawlers.

In one embodiment, the drive 302 may include legs.

In one embodiment, the drive 302 may include a means (not shown) for changing a direction of advancement of the training device.

In one embodiment, the control circuit 306 may also be configured to control a specified direction of the training device by means of the means for changing the direction of advancement.

In one embodiment, the control circuit 306 may also be configured to reduce the specified speed on the basis of a rate of the change of the direction of advancement.

In one embodiment, the attachment set 300 may also include a GPS signal-receiving circuit (not shown), which may be configured to receive a GPS signal.

In one embodiment, the control circuit 306 may also be configured to control the specified direction of the training device on the basis of the GPS signal received.

In one embodiment, the attachment set 300 may also include a direction sensor (not shown), which may be configured to determine an orientation of the training device.

In one embodiment, the direction sensor may be or include a gyroscope and/or an acceleration sensor and/or a compass.

In one embodiment, the control circuit 306 may also be configured to control the specified direction of the training device on the basis of the orientation determined.

In one embodiment, the control circuit 306 may also be configured to specify a specified path of the training device.

In one embodiment, the control circuit 306 may also be configured to activate the drive 302 and for activating the means for changing the direction of advancement of the training device according to the specified path.

In one embodiment, the attachment set 300 may also include a distance sensor (not shown), which may be configured to determine a distance of the training device 300 from an obstacle.

In one embodiment, the control circuit 306 may also be configured to specify a reduction in the speed of the drive on the basis of a specified condition for the distance determined.

In one embodiment, the attachment set 300 may also include an emergency-off switch (not shown), which may be configured to determine a hazardous situation.

In one embodiment, the control circuit 306 may also be configured to specify a reduction in the speed of the drive 302 on the basis of a specified condition for the hazardous situation determined.

In one embodiment, the attachment set 300 may also include a sensor (not shown), which may be configured to determine the at least one physiological parameter and for transmitting the physiological parameter determined to the control circuit via the interface.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the control circuit 306 may also be configured to increase the specified speed on the basis of a first specified condition for the physiological parameter received and for reducing the specified speed on the basis of a second specified condition for the physiological parameter received.

In one embodiment, the control circuit 306 may also be configured to specify the speed such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the control circuit 306 may also be configured to specify the speed on the basis of a continuing training time.

In one embodiment, the control circuit 306 may also be configured to specify the speed on the basis of a training distance covered.

In one embodiment, the control circuit 306 may also be configured to specify the speed on the basis of a current position of the training device.

In one embodiment, the attachment set 300 may also include a user-input circuit (not shown), which may be configured to receive a user input. The control circuit 306 may also be configured to specify the speed on the basis of the user input received.

Figure 4:
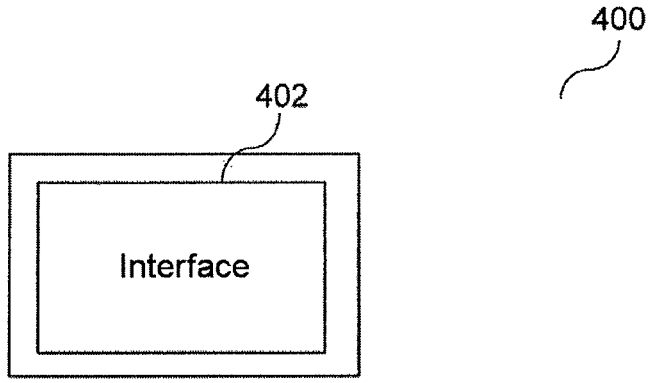
FIG. 4 shows a control circuit according to an embodiment.

FIG. 4 shows a control circuit 400 according to an embodiment. The control circuit 400 may be a control circuit for controlling a training device. The control circuit 400 may include an interface 402, which may be configured to receive a physiological parameter of a user of the control circuit. The control circuit 400 may be configured to specify a speed of advancement of the training device on the basis of the physiological parameter received.

In one embodiment, the control circuit 400 may also be configured to activate a drive of the training device according to the specified speed.

In one embodiment, the control circuit 400 may also be configured to control a specified direction of the training device by means of a means for changing the direction of advancement of the training device.

In one embodiment, the control circuit 400 may also be configured to reduce the specified speed on the basis of a rate of the change of the direction of advancement.

In one embodiment, the control circuit 400 may also include a GPS signal-receiving circuit (not shown), which may be configured to receive a GPS signal.

In one embodiment, the control circuit 400 may also be configured to control the specified direction of the training device on the basis of the GPS signal received.

In one embodiment, the control circuit 400 may also include a direction sensor (not shown), which may be configured to determine an orientation of the training device.

In one embodiment, the direction sensor may include or be a gyroscope and/or an acceleration sensor and/or a compass.

In one embodiment, the control circuit 400 may also be configured to control the specified direction of the training device on the basis of the orientation determined.

In one embodiment, the control circuit 400 may also be configured to specify a specified path of the training device.

In one embodiment, the control circuit 400 may also be configured to activate the drive and for activating the means for changing the direction of advancement of the training device according to the specified path.

In one embodiment, the control circuit 400 may also include a distance sensor (not shown), which may be configured to determine a distance of the training device from an obstacle.

In one embodiment, the control circuit 400 may also be configured to specify a reduction in the speed of the drive on the basis of a specified condition for the distance determined.

In one embodiment, the control circuit 400 may also include an emergency-off switch, which may be configured to determine a hazardous situation.

In one embodiment, the control circuit 400 may also be configured to specify a reduction in the speed of the drive on the basis of a specified condition for the hazardous situation determined.

In one embodiment, the control circuit 400 may also include a sensor, which may be configured to determine the at least one physiological parameter and for transmitting the physiological parameter determined to the control circuit via the interface 402.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the control circuit 400 may also be configured to increase the specified speed on the basis of a first specified condition for the physiological parameter received and for reducing the specified speed on the basis of a second specified condition for the physiological parameter received.

In one embodiment, the control circuit 400 may also be configured to specify the speed such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the control circuit 400 may also be configured to specify the speed on the basis of continuing training time.

In one embodiment, the control circuit 400 may also be configured to specify the speed on the basis of a training distance covered.

In one embodiment, the control circuit 400 may also be configured to specify the speed on the basis of a current position of the training device.

In one embodiment, the control circuit 400 may also include a user-input circuit (not shown), which may be configured to receive a user input. The control circuit 400 may also be configured to specify the speed on the basis of the user input received.

Figure 5:
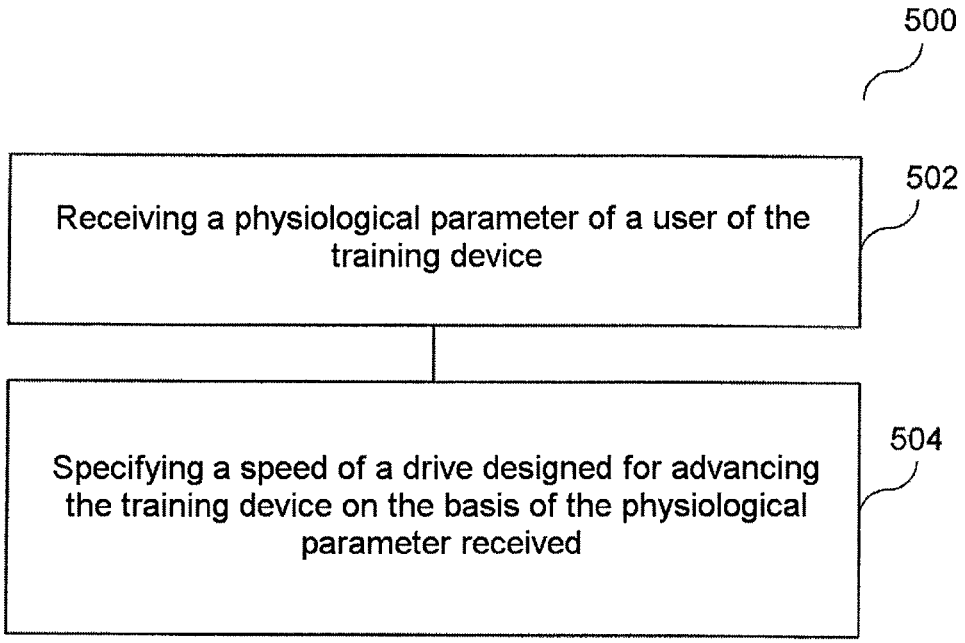
FIG. 5 shows a flow diagram which illustrates a method for controlling a training device according to an embodiment.

FIG. 5 shows a flow diagram 500, which illustrates a method for controlling a training device according to an embodiment. In 502, a physiological parameter of a user of the training device can be received. In 504, a speed of a drive configured to advance the training device can be specified on the basis of the physiological parameter received.

In one embodiment, the drive may be activated according to the specified speed.

In one embodiment, a specified direction of the training device may also be controlled by means of a means for changing the direction of advancement of the training device.

In one embodiment, the specified speed may also be reduced on the basis of a rate of the change of the direction of advancement.

In one embodiment, a GPS signal may also be received.

In one embodiment, the specified direction of the training device may also be controlled on the basis of the GPS signal received.

In one embodiment, an orientation of the training device may also be determined.

In one embodiment, the specified direction of the training device may also be controlled on the basis of the orientation determined.

In one embodiment, a specified path of the training device may also be specified.

In one embodiment, the drive may also be activated for changing the direction of advancement of the training device according to the specified path.

In one embodiment, a distance of the training device from an obstacle may also be determined.

In one embodiment, a reduction in the speed of the drive may also be specified on the basis of a specified condition for the distance determined.

In one embodiment, a hazardous situation may also be determined.

In one embodiment, a reduction in the speed of the drive may also be specified on the basis of a specified condition for the hazardous situation determined.

In one embodiment, the at least one physiological parameter may include or be an oxygen saturation of a user of the training device and/or a skin conductivity of a user of the training device and/or a heart rate of a user of the training device and/or a respiration rate of a user of the training device and/or a body temperature of a user of the training device and/or a blood pressure of a user of the training device and/or an energy consumption of a user of the training device.

In one embodiment, the specified speed may also be increased on the basis of a first specified condition for the physiological parameter received and/or the specified speed may be reduced on the basis of a second specified condition for the physiological parameter received.

In one embodiment, the speed may also be specified such that the at least one physiological parameter lies in a specified range.

In one embodiment, the specified range may be variable with a continuing training time.

In one embodiment, the specified range may be variable with a training distance covered.

In one embodiment, the specified range may be variable with a current position of the training device.

In one embodiment, the speed may also be specified on the basis of a continuing training time.

In one embodiment, the speed may also be specified on the basis of a training distance covered.

In one embodiment, the speed may also be specified on the basis of a current position of the training device.

In one embodiment, a user input may also be received and the speed may be specified on the basis of the user input received.

Further embodiments are described below.

In an embodiment, a self-propelled training device, which as a pacemaker assists targeted movement training or running training on the basis of measured physiological values, is provided.

The invention concerns a self-propelled, manually controllable or programmable training device for assisting outdoor running training ("Outdoor Ergometer"). The training device performs a similar function to a treadmill, which by using a variable speed subjects the user to changing physical exertion and, with regular use, over the medium and long term leads to better fitness and a greater resilience and endurance of the cardiovascular system of the user. By contrast with a treadmill, however, said training device is not fixed in place. Rather, it is designed as a vehicle which, driven by one or more motors, travels at a variable speed ahead of the user as a pacemaker and dictates the running speed for the user.

The traveling speed of the training device is controlled by a control unit by using a directly specified speed setting or indirectly in dependence on a measured physiological value of the user ("biosignal" for short), such as for example the heart rate or respiration rate or else a prognosticated energy consumption. In the case of indirect control by means of a measured physiological value, this value is measured by means of a suitable sensor, for example a heart rate monitor, and transmitted to a control computer. This computer compares the controlled variable with a specified measured value, calculates a correction value, for example a difference value, and corrects the speed of the vehicle correspondingly.

The training device can take the form of several configurations: just speed control (manually or program-controlled, directly or indirectly by using measured physiological values); speed control and direction stabilization; autopilot (automatic travel over a training route); autopilot with automatic obstacle avoidance; modular device configuration for mounting for example on children's buggies, golf trolleys or walking aids.

A self-propelled, manually controllable or programmable training device for assisting outdoor running training may be provided in various embodiments.

Figure 6A:
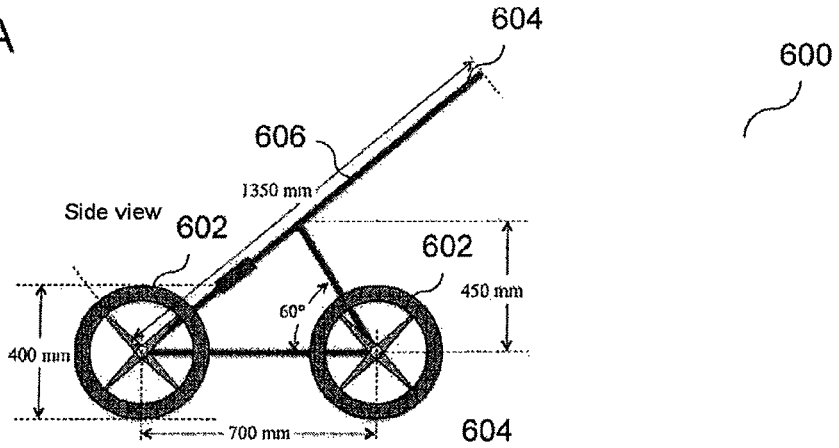
FIG. 6 shows a mechanical structure, given by way of example, of a training device according to an embodiment.
Figure 6B:
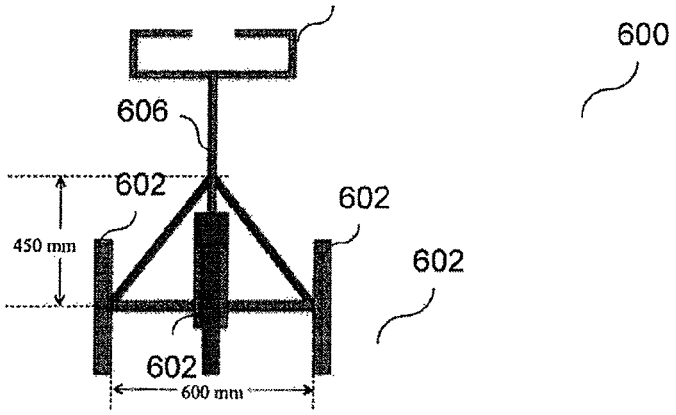
Figure 6C:
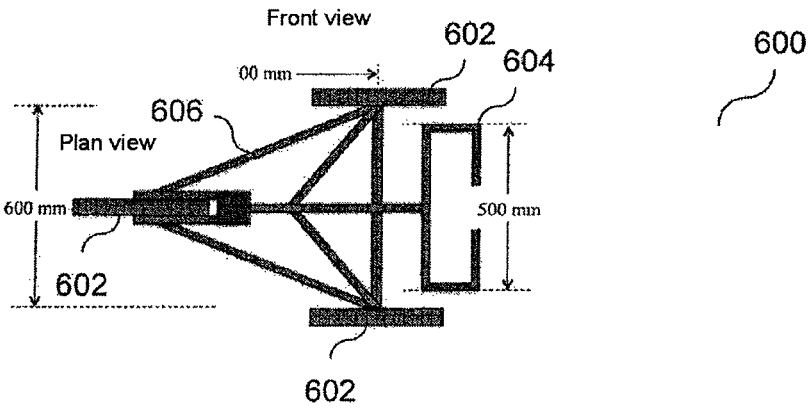

FIG. 6 shows a mechanical structure, given by way of example, of a training device 600 according to an embodiment. FIG. 6A shows a side view, FIG. 6B shows a front view and FIG. 6C shows a plan view. The training device 600 may have one or more drives, for example wheels 602, a frame 606 and a handlebar 604.

Figure 7:
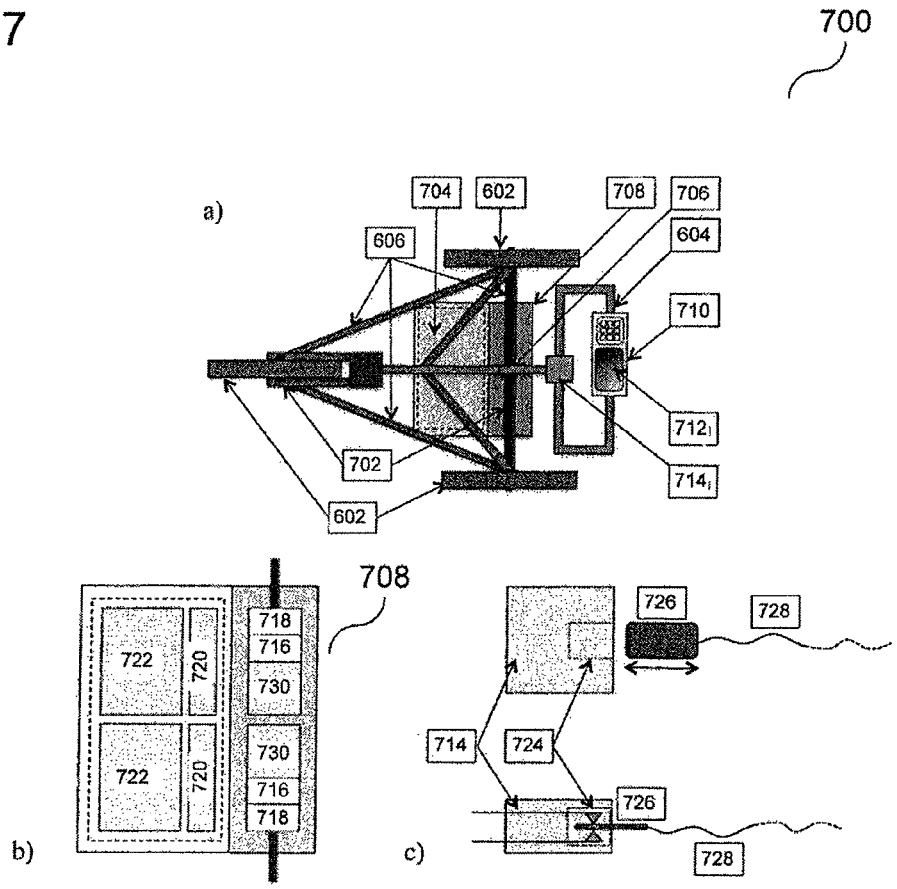
FIG. 7 shows a schematic arrangement, given by way of example, of components according to an embodiment.

FIG. 7 shows a schematic arrangement 700, given by way of example, of components according to an embodiment. A plan view 700 of a training device is shown under a), a view of a detail of a drive unit 780 is shown under b) and two embodiments of a safety device 714 are shown under c).

Figure 8:
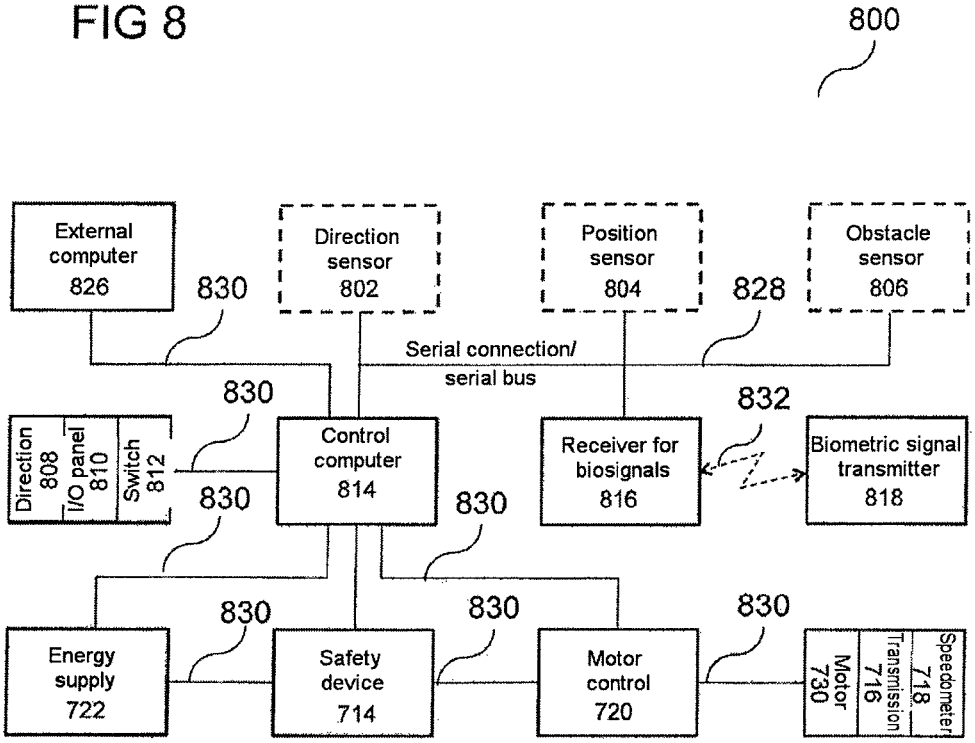
FIG. 8 shows an interconnection of the components according to an embodiment.

FIG. 8 shows an interconnection 800 of the components according to an embodiment.

It is understood that the following listing of components does not have to be complete and that not every one of the components listed must be included. Each of the following components, which belong to a basic configuration of the training device, is represented in the figures by solid lines. Components that may constitute part of extensions are represented by broken lines.

The training device may include the following main and secondary components:

- chassis 600 with
  - frame 606 with axles 702,
  - wheels (three or more) or crawlers or skis or a combination thereof 602,
  - support for drive unit and power supply 704,
  - steering column 706 with handlebar 604,
- drive unit 708 with
  - motor 730 (one or more; for example electric motor and/or internal combustion engine),
  - transmission 716,
  - measuring device for measuring the traveling speed and distance ("speedometer/odometer") 718,
  - motor control 720,
  - energy supply, for example power supply 722 by means of battery with charging connection,
- control circuit, for example a control unit 710, with
  - computer 814 with
  - receiver for measured physiological values 816,
  - device for traveling direction measurement ("direction sensor"), for example digital compass, gyroscope or inertial measuring unit 802,
  - device for global positional determination ("position sensor"), for example GPS 804,
  - device for detecting obstacles ("obstacle sensor") 806, connected to a device for determining the angle of rotation (roll, turn and tilt angle) of the obstacle sensor about its principal axes,
  - connection to input/output unit,
  - connection to motor control,
  - connection to safety switch,
  - connection to PC,
  - connection to energy supply,
- input/output unit 712 with
  - on/off switch 812,
  - input/output panel 810,
  - input element for specified direction setting 808, for example button, rocker switch, control lever,
  - control lever for changing direction and speed, additional operating elements (switches or levers), sensor for physiological parameters (heart rate, respiration rate or other measured physiological values for monitoring the cardiovascular system) ("biosignal monitor") 818, safety device 714 with safety switch 724, safety connector or clip 726, safety line 728, and safety belt (around hips or wrist).

The control computer 814 may be coupled via a serial connection or a serial bus 828 to the direction sensor 802, the position sensor 804 and the obstacle sensor 806. All of the components shown may be coupled via an electrical or optical connection 830. The biometric signal transmitter 818 (in other words: the signal transmitter for physiological parameters) may be coupled to the receiver for biosignals 816 (in other words: the receiver for physiological signals) via a wireless or wire-bound connection 832.

A simple device configuration is described below.

One component of the control (in other words: of the control circuit) is the control computer 814, which may be designed either as an embedded PC or alternatively as a microprocessor with corresponding interfaces. The control computer is connected via signal lines, which are designed as an interruption signal, serial interface or as a serial bus, to all of the other components of the control circuit. The control computer is supplied with power by the energy supply 722, for example a battery. It reads corresponding inputs from the input/output unit 712 and measured physiological values from the receiver 816. On the basis of these inputs and signals, it calculates corresponding specified control settings for the motor control 720.

By means of an interruption signal or a periodically interrogated serial line, the computer is connected to the safety device 714. The control computer may be connected via a serial interface to an external computer and exchange data and programs with it.

The motor control 720 has power electronics, which specify the rotational speed and direction of rotation of the motor. The motor control 720 is connected via a serial line to the control computer and receives specified speed settings from the latter. If the training device is equipped with multiple drive motors, they are generally controlled by multiple motor controls, which are connected in the same way to the control computer. Mechanically connected to the motor is a transmission 716, which suitably converts the rotational speed and the power of the motor. Connected to the transmission is a signal transmitter 718, which determines the rotational speed of the wheel and, with a given wheel circumference, determines from it the way traveled. The motor and the motor control are supplied with the necessary drive energy by the energy supply 722.

The connection between the energy supply and the motor and the motor control leads via the safety device 714. If the safety chip or connector 726 is removed from the safety device, the energy supply of the motor and the motor control is interrupted and the drive of the training device is deactivated.

The switching on and off of the training device, the selection of programs, the input of controlled variables, the output and in particular graphic representation of controlled and measured variables takes place by means of the input/output unit 712. The input/output unit consists of the subcomponents input/output switch 812, input/output panel 810, element for specified direction settings 808, and further input/output elements for changes of direction and speed. It is connected via a serial interface to the control computer. The on/off switch 812 and the input/output panel 810 may possibly be integrated with the control computer in one unit. The input element for specified direction settings 808 and the further input/output elements (404 and 405) are then separately connected via serial connections to the control computer.

The sensor for physiological parameters ("biosignal monitor") 818 is worn by the user on the body and measures characteristic parameters such as heart rate, respiration rate or other physiological characteristics for monitoring the cardiovascular system. These are transmitted by radio waves or optical waves initially to the receiver for measured physiological values 816 and then further via a serial connection to the control computer 814.

Possible extended embodiments are described below.

The simple configuration of the training device may be extended by multiple components, in order in this way to realize additional functionalities.

The direction sensor 802, for example a digital compass, serves for determining the traveling direction of the training device and is connected by a serial connection or a serial bus, such as a USB, to the control computer 814. This computer enquires the present direction of the vehicle at regular time intervals. The direction sensor is used in the automatic direction stabilization, autopilot function and obstacle avoidance described later.

The position sensor 804, for example a sensor that receives its position from a satellite-based global positioning system such as NAVSTAR-GPS, Galileo or GLONASS (Russian for Globalnaja Nawigazionnaja Sputnikowaja Sistema, i.e. in English Global Satellite Navigation System), serves for determining the position of the training device. To increase the accuracy, additional corrective systems, such as WAAS (Wide Area Augmentation System) or EGNOS (European Geostationary Navigation Overlay Service), may be used (accuracy for example of between 1 and 3 m), or possibly the signals from multiple positioning systems may also be used simultaneously. The position sensor is likewise connected via a serial connection or serial bus to the control computer 814. The control computer reads the position data of the sensor at regular time intervals via the serial connection. The position sensor is used in the autopilot function and obstacle avoidance described later.

Distance-measuring 2D or 3D sensors are used as obstacle sensor(s) 806. For example, ultrasonic sensors, such as are used in parking aids, 2D or 3D laser rangefinders or microwave radar systems, such as are likewise already used in the automobile industry for measuring distance or controlling distance, are used. Suitable in particular are such sensors that have a range within which the training vehicle at maximum speed and with maximum deceleration can be brought to a standstill before an object. The obstacle sensors are attached to the training vehicle such that their range of detection or perception covers the space on the travelway that the vehicle can move into from the present position with all the allowed changes of direction.

Figure 9:
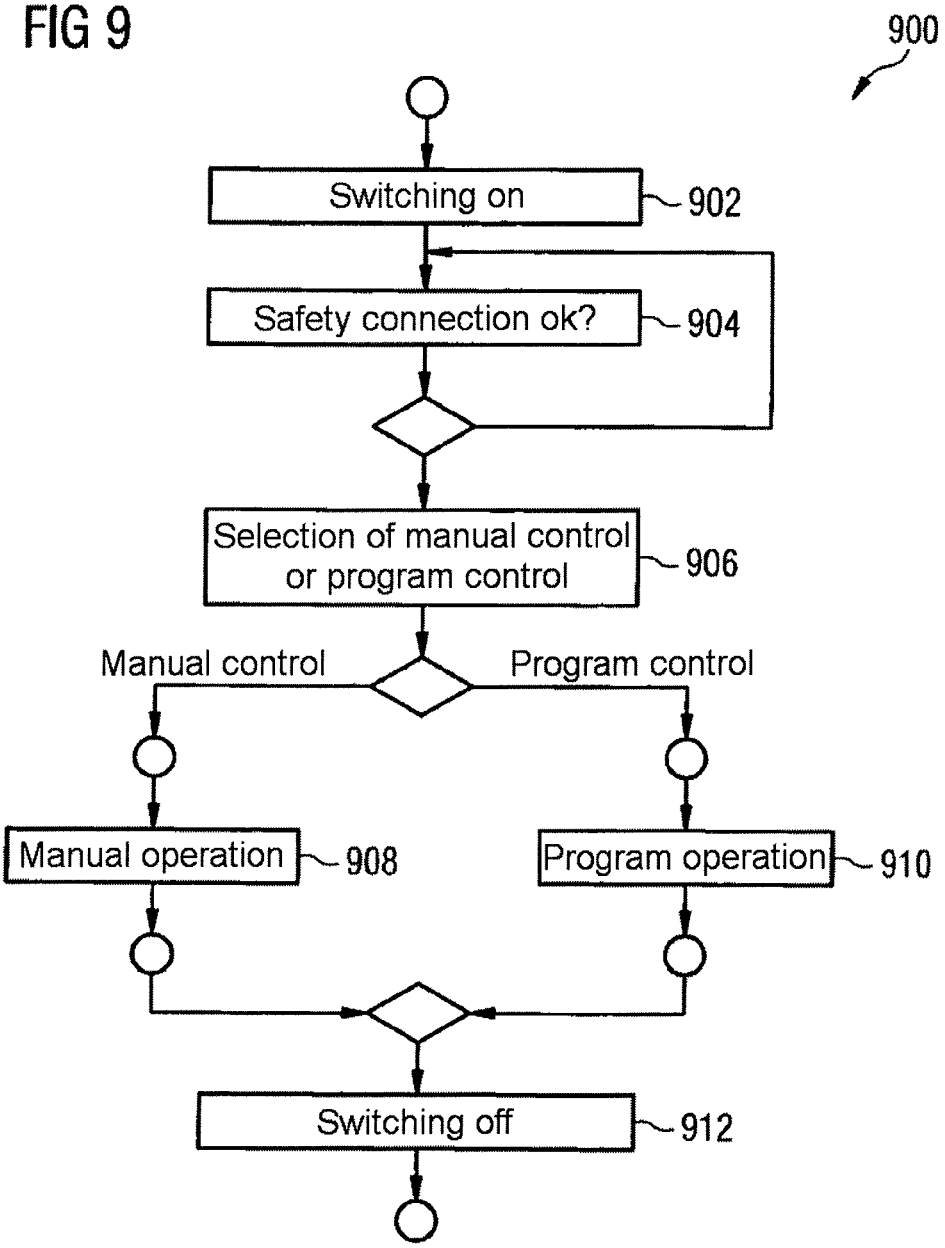
FIG. 9 shows a flow diagram which illustrates a method for selecting a manual control or program control according to an embodiment.

FIG. 9 shows a flow diagram 900, which illustrates a method for selecting a manual control or program control according to an embodiment.

When switching on the device in 902, the control 710 with all its components, the input/output unit 712 and the motor control 720 are activated.

On the input/output panel 810 there appears an interactive menu guide, with various displays or visual representations for measured physiological values (for example present value, average value, maximum value, progression over time of the heart rate, calorie consumption, respiration rate), for the reception strength of the physiological signals, for system states of the device such as (the present, average, maximum, progression over time of) the speed, battery life, distance traveled, and for ambient data such as for example the temperature.

After switching on the device, the control computer 814 checks in 904 whether the safety connector 726 with the safety line 728 fastened thereto is connected to the safety switch 724 or has been inserted into the safety switch and waits for an input on input/output panel 810. Without a connection, the training device cannot be moved (current feed from the current supply to the motors is interrupted). This is brought to the attention of the user, who is requested to make the connection.

The user can select in 906 whether he wishes to control the speed of the vehicle by the manual input of setpoint values (speed or physiological parameters) in 908 or whether he wishes to activate a training program in 910, by means of which the speed of the training device is then automatically controlled.

After the end of operation, the training device is switched off in 912.

Figure 10:
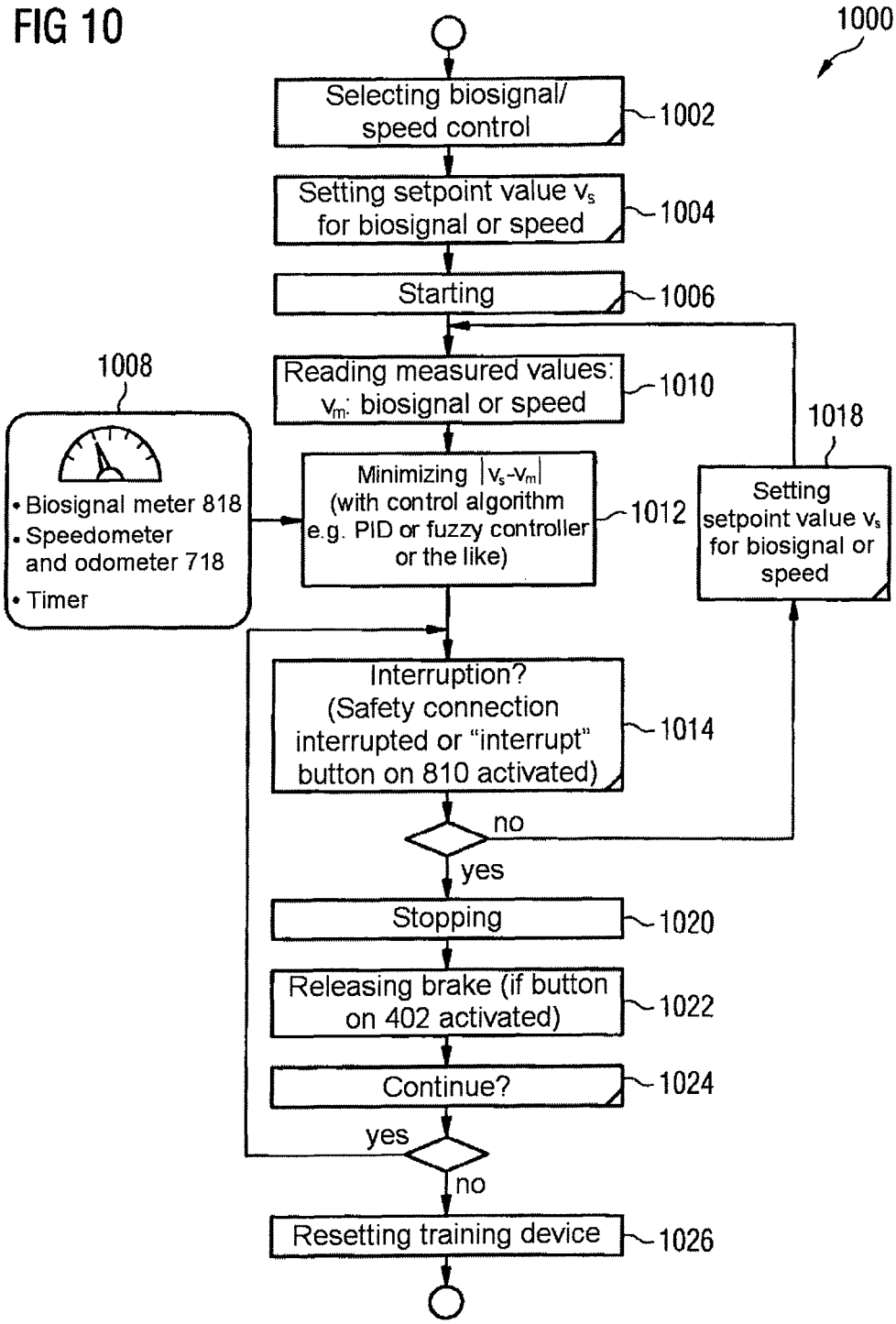
FIG. 10 shows a flow diagram which illustrates a method for manual control according to an embodiment.

FIG. 10 shows a flow diagram 1000, which illustrates a method for manual control according to an embodiment.

After selecting the option "manual control", the user can select on the input/output panel 810 in 1002 whether he wishes to specify the speed of the training device directly (speed control) or whether the speed is to be controlled indirectly in dependence on a physiological parameter ("biosignal control").

After selecting a setpoint value in 1004 or a training program, the user must in 1006 activate the "start" switch or button on the input/output panel in order to set the vehicle in motion.

After activating the "start" switch or button on the input/output panel, the computer begins in 1010 to measure or determine at regular time intervals the actual value $v_m$ of the selected signal (physiological parameter or speed) in 1008.

The computer compares the measured or filtered signal with the specified setpoint value $v_s$ and determines the difference between the two signals. By using a control method, the difference between the actual value $v_m$ and the setpoint value $v_s$ of the signal is minimized in 1012 and corresponding control signals are transmitted to the motor control (720).

If the user activates the "interrupt" button in 1014, then the speed of the training device is reduced to zero and the device stopped.

If while traveling the safety connector is removed in 1014, the energy feed to the motors is interrupted, as described below. As a result, the vehicle likewise comes to a standstill in 1020. At the same time, the setpoint value for the control is set to zero. If the safety connection is restored, the training device continues to travel in 1022 and 1024, unless the user ends the travel by activating the "end" button; in this case, the training device is reset in 1026.

In 1018, the user has the possibility of changing while traveling the setpoint value of the control signal and increasing or reducing his exertion, and accordingly the speed of the training vehicle, by means of corresponding areas in the input/output unit (810).

Figure 11:
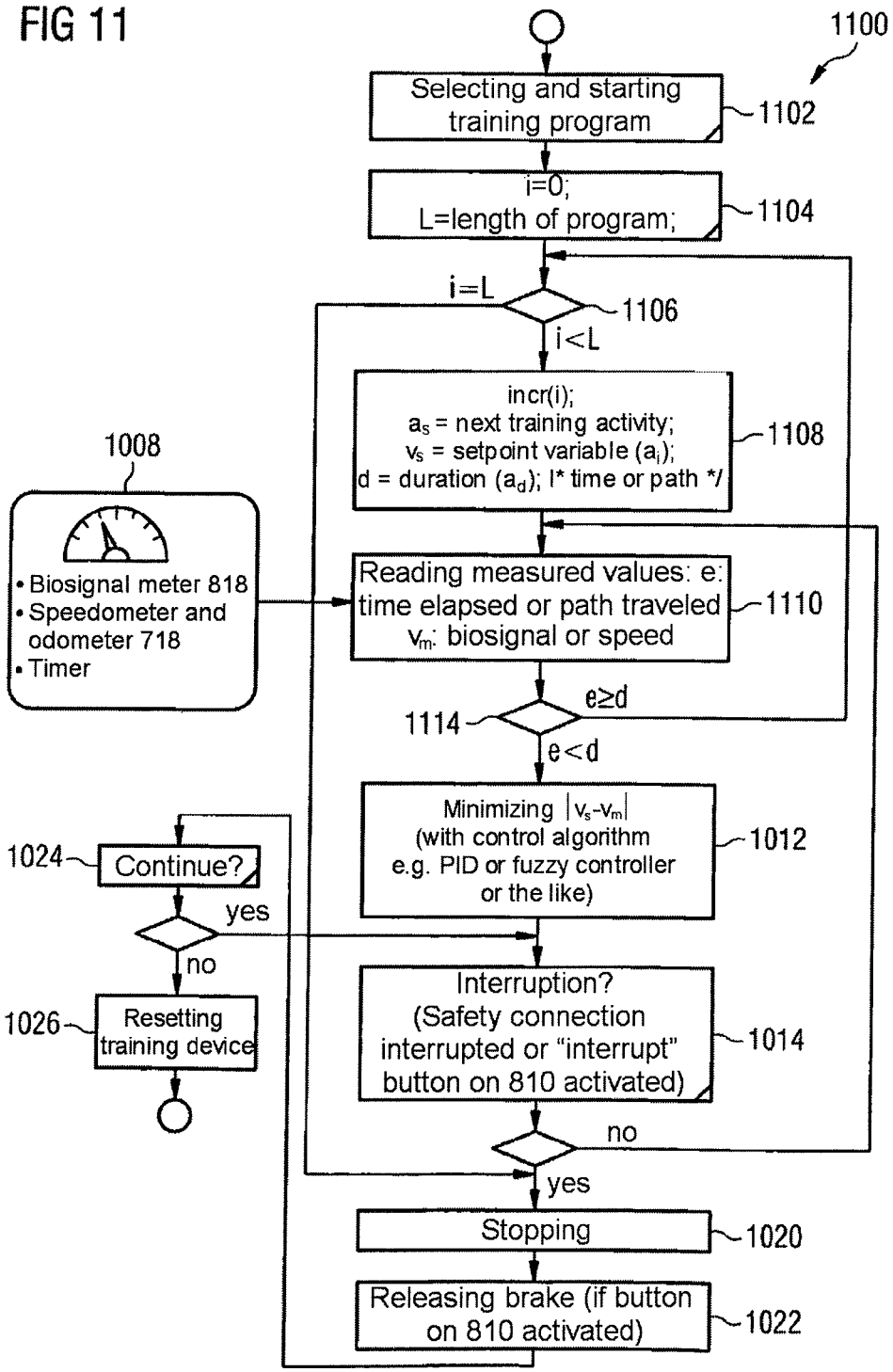
FIG. 11 shows a flow diagram which illustrates a method for program control according to an embodiment.

FIG. 11 shows a flow diagram 1100, which illustrates a method for program control according to an embodiment, steps that are similar to steps of the method described in FIG. 10 being able to have the same designations, and there being no need for them to be described twice.

Training programs can be loaded onto the control computer 814 via a temporary connection to an external computer 826, for example via a serial connection (by wire, radio or optical means). Alternatively, training programs may also be created directly on the control computer by means of an editor. A training program consists of a sequence 1200 of setpoint variables (speed or physiological parameter), which are valid for a certain period of time or length of the way, as shown for example in FIG. 12.

The training program is executed by the control computer in a similar manner as if the user were to enter a setpoint value manually and operate the vehicle for a certain time or over a certain way with this setpoint value before manually entering the next value, and continue in this way until the training is ended.

In 1102, the training program is selected and started.

In 1104, a counting variable i is set to 0 and a program length L is set in a manner corresponding to the program chosen.

In 1108, the control computer accesses step by step the next entry not yet referred to in the sequence, takes it as the new setpoint value and controls the traveling speed of the training device directly or indirectly with this setpoint value for a specified period of time.

After the time interval has elapsed or the length of the way has been covered (which may take place for example by reading of the measured values in 1110 and subsequent comparison in 1114), the control computer accesses the next entry in the sequence and repeats the procedure just described until the sequence has been executed completely (for example until i is equal to L in 1106).

In 1020, the device comes to a standstill if either the user has activated the "interrupt" button in 1014 or the training program has been executed (case i=L in 1106) or the safety connector is removed. In all cases, the control computer reduces the speed of the training device to zero.

In the first two cases, there appear on the input/output panel 810 two buttons "end" and "continue". For the actual ending of the training program, the user must activate the corresponding button.

If the user only wishes to interrupt the training program temporarily—for example in order to take a break in training—and continue it at a later point in time, he can do this by activating the "continue" button. The program is then continued from where it was interrupted. If the user ends the program, the vehicle is reset to the initial state and can be switched off.

Figure 13:
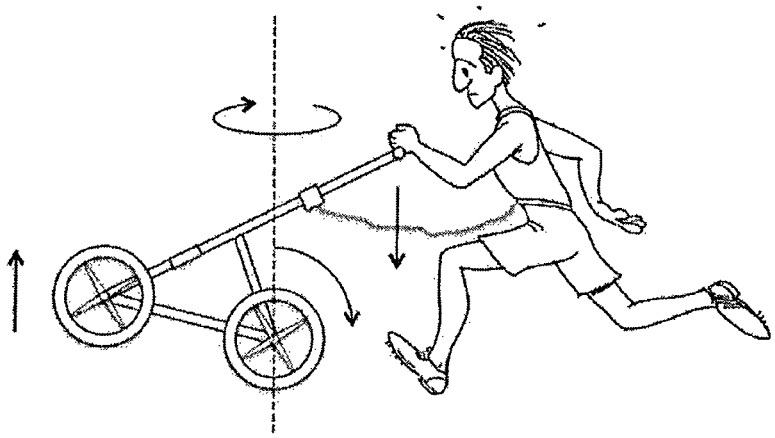
FIG. 13 shows an illustration of a possibility for changing the direction according to an embodiment.

FIG. 13 shows an illustration 1300 of a possibility for changing the direction according to an embodiment.

In an embodiment, only the traveling speed of the training device can be automatically controlled, as described above.

In this case, the kinematics of the vehicle allow a movement only in one fixed direction. Once set in motion, the training device moves in this one fixed direction until it is stopped, either by reducing the speed or by triggering the safety switch or by an obstacle.

Unintentional changes of direction, which may be caused for example by one of the drive wheels traveling over an unevenness or slipping, are not compensated. The vehicle may therefore veer away from the traveling direction if the traveling direction is not corrected by the user.

A change or correction of the traveling direction of the training device may for example be performed as follows: by exerting a small force on the handlebar downward in the direction of the ground, the user can raise the front wheel of the training device (as shown in FIG. 13), turn the vehicle in the desired new direction by means of the wheels of the rear axle and then set the front wheel onto the ground again by releasing the pressure on the handlebar. The training device travels in the new direction until it is stopped or the direction is changed again.

Figure 14:
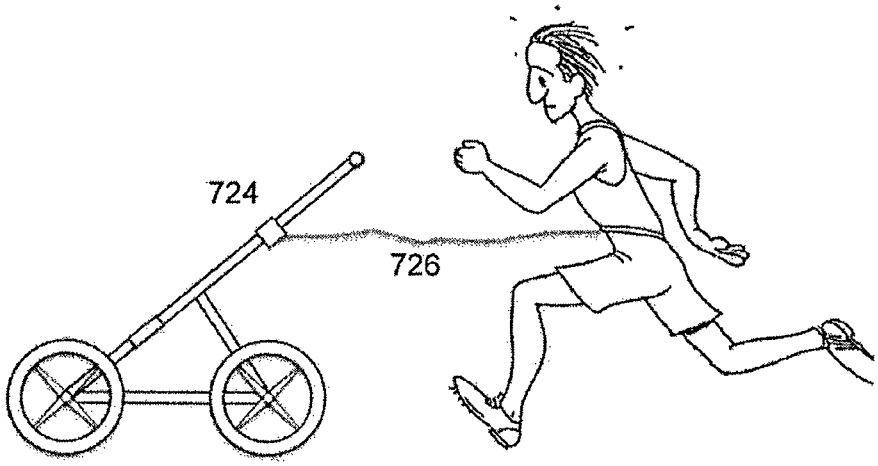
FIG. 14 shows an illustration of safety device according to an embodiment.

FIG. 14 shows an illustration 1400 of a safety device according to an embodiment.

For safe operation of the vehicle, it may be desired that the training vehicle can never move away of its own accord further than a specified maximum distance. Should this distance be exceeded, the training vehicle should then under any circumstances be braked and stopped. A safety device that performs the function just described is described below by way of example.

In an embodiment, as shown in FIG. 14, the training device and the user may be connected by a safety line 728. One end of this safety line is connected to the wrist or hips of the user. The other end is connected to a safety connector or chip 726, which is inserted into the safety switch 724 and establishes an electrical connection between (a) motor(s) and a power supply (see FIG. 7 *c*).

If the user can no longer follow the training device, for example because of fatigue, distraction or even injury, the safety line is tensioned and, with increasing tension, the safety connector or chip is removed from the safety switch.

This removal has the effect that the connection between the motor(s) 730 and the power supply 722 is interrupted and the device is braked, for example by a motor brake, and comes to a standstill. The running of the program on the control computer is interrupted. The computer goes into a standby position and reports the interruption of the safety connection to the user by means of the input/output unit.

If the user inserts the safety connector 726 back into the safety switch 724, the control computer continues the training travel session, by increasing the speed of the training vehicle until the measured value for the control signal matches the setpoint value.

If the user does not set the training device in motion by activating the "start" or "continue" buttons, the control computer controls the speed of the training device down to zero. This means that the drive motors are blocked and the device cannot move or be moved.

During this state, a "release brake" button appears on the input/output unit. Only by activating this button can the user release the drive motors or wheels and move the device freely as desired by physical force.

An embodiment of a device configuration with direction stabilization is described below.

A training device with direction stabilization resembles the simple device configuration, in particular with regard to the safety device and with regard to the setting and control of the speed of the vehicle. As in the simple device configuration, the training vehicle may be controlled either by a training program or manually. In addition, the training device may be controlled in a fixed specific direction, with automatic compensation for unintentional changes of direction, for example due to unevennesses in the ground.

A device configuration with direction stabilization may include two or more drive motors 730, which are for example designed as a differential drive, one or more steerable wheels, in addition a direction sensor 802 (for example a digital compass, gyroscope or inertial measuring unit), in addition one or more input elements for specified direction setting 808 (for example a button, rocker switch, control lever) and individual mechanical or electrical wheel brakes for two or more wheels.

The traveling direction can be fixed as follows before traveling. After setting the setpoint value, by means of which the speed of the vehicle is controlled, or after selection of a training program and before the user starts the training device (the "start" button is deactivated), the user must specify the initial traveling direction (a request is displayed by means of the input/output unit). For this purpose, the user has to align the training device in the desired direction and activate the input element for specified direction setting 808 for several seconds on the handlebar (for example pressing a "(traveling) direction" button). After activating the input element, the control computer reads the direction value displayed by the direction sensor, possibly even a number of times. Following that, the control computer determines from the direction values read from the direction sensor a new desired direction for the training vehicle. This desired direction may for example be the average value of the values read from the direction sensor. After that, the "start" button is activated on the input/output unit and the user can start the training device by pressing/touching the button.

Figure 15:
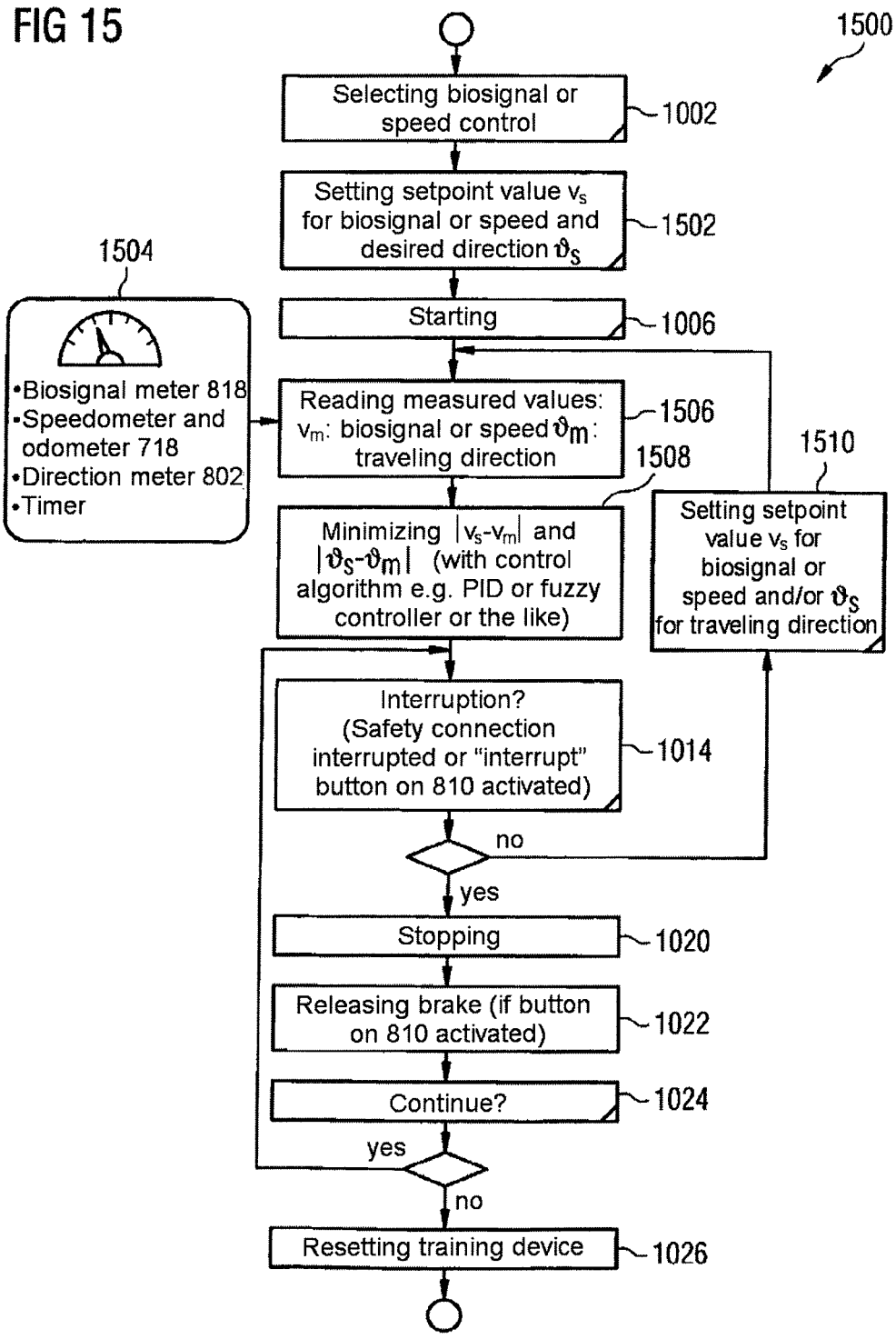
FIG. 15 shows a flow diagram which illustrates a method for manual control with direction stabilization according to an embodiment.

FIG. 15 shows a flow diagram 1500, which illustrates a method for manual control with direction stabilization according to an embodiment, steps that are similar to steps of the method described in FIG. 10 being able to have the same designations, and there being no need for them to be described twice.

The user can specify setpoint values for the biosignal (in other words: the physiological parameter or the physiological parameters) and/or the speed and/or the desired direction in 1502.

While traveling, the control computer reads in 1506 the current course at regular time intervals from the direction sensor (which measures the direction in 1504) and compares this current value with the desired direction. If the actual traveling direction deviates from the desired direction, the control computer changes the rotational speeds of the drive motors, for example by sending corresponding specified settings to the motor control or by activating a brake, in order to minimize the difference between the actual traveling direction and the desired direction in 1508. The direction stabilization is interrupted as soon as the user activates the input element for specified direction setting.

In 1510, the setpoint values for the biosignal (in other words: the physiological parameter or the physiological parameters) and/or the speed and/or the desired direction can be set.

The flow diagram 1500 is a flow diagram in which the direction stabilization is combined with manual control. A similar sequence is obtained for the combination of direction stabilization and program control.

Changes of direction of the training device while traveling can be carried out in various ways. Several variants are described below by way of example:

raising front wheel and activating an input element for the (traveling) direction, control lever for change of direction and speed, and individual mechanical or electrical wheel brake.

A change of direction by raising the front wheel and activating an input element for the (traveling) direction is described below. The user activates the input element for the (traveling) direction 808. While the input element is activated, no automatic course correction is carried out. All of the drive wheels rotate at the same speed. With the input element activated, the user raises the front wheel of the training device, turns the device into the desired traveling direction and sets the front wheel down again, as described above. After setting the front wheel down, the user keeps the input element activated for several more seconds. As long as the input element is activated, the control computer reads one or more direction values from the direction sensor. After deactivating the input element (letting go the switch or lever), the control computer calculates a new desired direction for the training vehicle, for example by using the average value taken from the direction values read.

A change of direction by a control lever for a change of direction and speed is described below. In this embodiment, the input element for the (traveling) direction 808 is combined with a control lever for the change of direction and speed. Like the control lever of a remote control, this control lever can be tilted in all directions. The reference point for directional indications "left", "right", "forward", "back" is the user. Tilting forward or back serves as an indication that the speed of the training device is to be increased or reduced. Tilting to the right or to the left serves as an indication that the direction is to be changed to the right or to the left. In the case of tilting of the control lever to the right or left, the control computer changes the rotational speed of the wheels, for example by raising or lowering the rotational speed of the motors until the user returns the control lever to the neutral position, and in this way signals that the desired traveling direction has been reached. The control computer determines the new desired direction for the control by reading out the directional indication from the direction measuring instrument after the return to the neutral position and calculating from this the new setpoint variable for the traveling direction by using a suitable method. The automatic control of the traveling speed of the training device is suspended during the change of direction, or overwritten by the specified settings of the control lever. After return of the control lever to the neutral position, the automatic control of the traveling speed of the training device becomes active again and the training device returns to the original speed. If the control lever is tilted forward or back, the control computer increases or reduces the speed of the training vehicle until the user returns the control lever to the neutral position. During this operation, the automatic control of the traveling speed of the training device is suspended and overwritten by the specified settings of the control lever. After return of the control lever to the neutral position, automatic control of the traveling speed of the training device becomes active again and the training device returns to the original speed.

A change of direction by an individual mechanical or electrical wheel brake is described below. In the case of this embodiment, the training device is equipped with a device that allows an individual reduction in the speed of the drive wheels. The mechanical configuration of the device consists of two brake levers, which as in the case of a bicycle are attached on the left and right sides of the handlebar. The two brake levers are connected by a brake cable to mechanical block brakes. The electrical configuration of the device consists of two rocker switches, which like the brake levers are attached on the left and right sides of the handlebar. Both switches are connected to the control computer. If the user actuates the rocker switch on one side of the training device, the control computer reduces the rotational speed of the motor of the drive wheel on this side until the user returns the switch to the neutral position. If both switches are activated, the control computer then accordingly reduces the rotational speed of the motors of both drive wheels. During the actuation of the rocker switches, the automatic control of the traveling speed of the training device is deactivated and overwritten by the specified settings of the switch or switches. After return of the switch or switches to the neutral position, automatic control of the traveling speed of the training device becomes active again and the training device returns to the original speed.

According to an embodiment, a device configuration with an autopilot function may include in addition to the direction stabilization a device that allows an advancement along a series of waypoints and an automatic location-dependent direction determination to reach these waypoints. The way in which the autopilot functions is described below.

An embodiment with an autopilot function may have in addition to the device configuration with direction stabilization a position sensor 804.

An advancement along a series of waypoints is described below.

Figure 16:
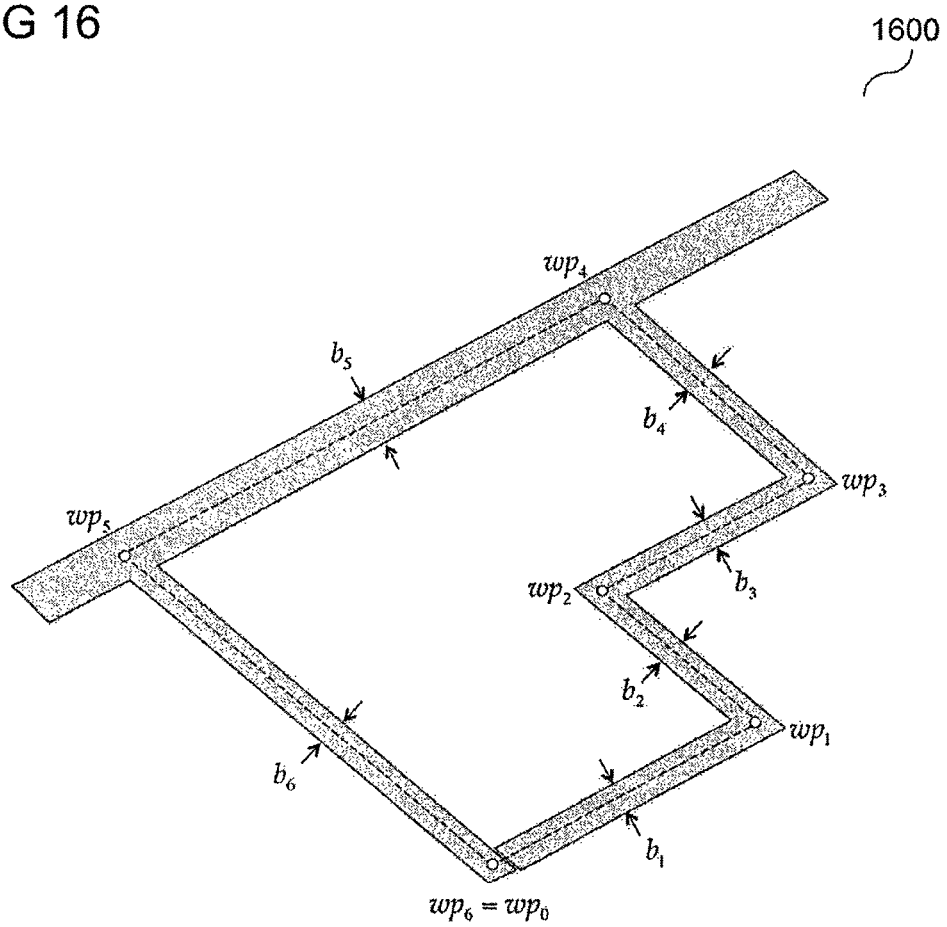
FIG. 16 shows an example a traveling route according to an embodiment.

FIG. 16 shows an example 1600 of a traveling route according to an embodiment.

By contrast with the speed control, which is largely location-independent and relates to aspects of the running training, the traveling direction of the training device is to a great extent location-dependent. The changes of direction that go beyond direction stabilization take place at specific locations, known as waypoints. These waypoints are uniquely described by means of global coordinates (for example longitude and latitude).

The traveling route of the training device over a series of such waypoints is marked in the manner shown in FIG. 16. The distance along the way between two successive waypoints may also be referred to as a way segment. The waypoints or way segments may for example be stored in a list, which the control computer can access sequentially.

For an efficient representation of the traveling route, those waypoints at which a change of direction is to be performed, for example in curves or at junctions, are sufficient. However, it may be desired to use significantly more waypoints. A more detailed representation of the traveling route by using a greater number of waypoints allows for example more detailed tracking and allows better allowance to be made for conditions of the terrain and roadway, such as for example narrower sections of the roadway, and the traveling route to be correspondingly adapted.

During operation in autopilot mode, the training device travels of its own accord from waypoint to waypoint until the last waypoint is reached and the route has been completed.

To determine the momentary position of the training device, while traveling the control computer continually reads the position values measured by the position sensor 804 and determines the geographical distance between the momentary position and the waypoint headed for.

Figure 17:
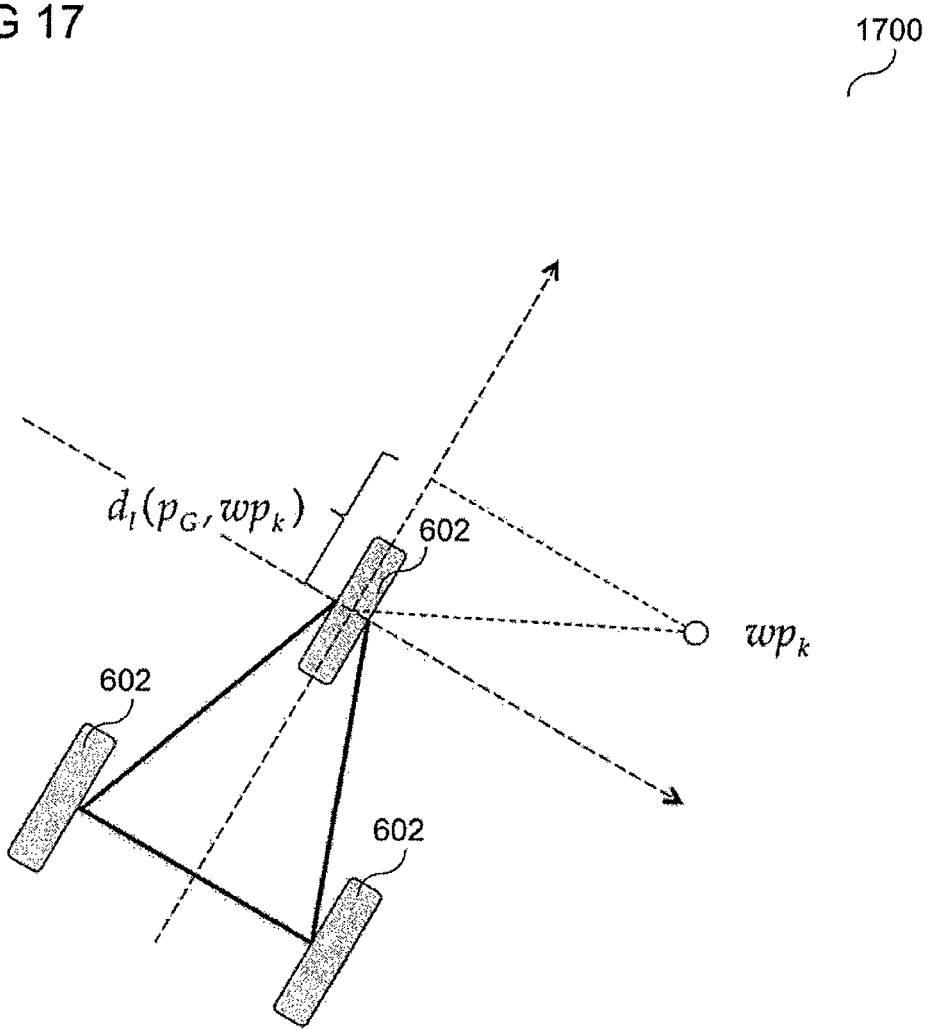
FIG. 17 shows an illustration of a longitudinal distance according to an embodiment.

The control computer considers a waypoint to be reached when both the absolute distance $d(p_G, wp_k)$ and the (longitudinal) distance $d_1(p_G, wp_k)$ between the projection of the waypoint headed for at the time onto the center line of the vehicle and a reference point on the vehicle is below a specified minimum value, as shown in the illustration 1700 in FIG. 17.

The control computer then chooses the next waypoint in the list and regards it as the next intermediate target to be reached. If there is no further waypoint in the list, the target of the traveling route has been reached and the training vehicle is stopped.

A determination of the traveling direction according to an embodiment is described below.

The momentary position of the training device and the position of the waypoint headed for at the present time also determine the setpoint value for the traveling direction of the training device. The shortest distance between two points on the Earth's surface is referred to as an orthodrome.

To determine the traveling direction of the training device, the formulas used in nautical navigation for calculating the course angle along an orthodrome can be used.

The course angle calculated in this way is specified to the direction stabilization as the desired direction. As described, the direction stabilization compares the direction read out from the direction sensor with the desired direction and, if need be, carries out a directional correction.

An interaction of the autopilot function and speed control according to an embodiment is described below.

The operation of the autopilot and the associated automatic direction control generally takes place in interaction with a training program, which controls the speed of the training vehicle directly or by using measured physiological values. The following description relates initially only to this operating mode, in which the autopilot is used in combination with a training program.

When traveling straight ahead and when there are slight changes of direction, the direction control and speed control of the training device are independent. The direction control does not have any influence on the speed control and the speed control does not have any influence on the direction control.

A clear reciprocal effect between the direction control and the speed control arises when traveling in a curve. In this case, excessive speed or an excessively abrupt change of direction may lead to an unstable position of the training device.

However, it is not necessary for the training programs to be modified such that the speed of the vehicle ultimately derived from them does not lead to unstable situations in order to avoid these reciprocal effects. The training programs therefore do not necessarily have to be made subordinate to the needs of the autopilot function.

Rather, the stability of the vehicle and the maintenance of a minimum curve radius or maximum curve speed can be achieved by using corresponding settings in the control of the training device, which may then lead to short-term deviations from the programmed speeds or physiological characteristic and from the traveling directions specified (by using the position of the waypoints).

Even if the training programs can be developed independently of the requirements of the autopilot function (automatic direction control), it may be desired that account is taken of the circumstances and characteristics of a traveling route in the creation of a training profile. Otherwise, there is the risk that the training rhythm is unnecessarily adversely affected by the autopilot. Thus it is advisable, for example, to make allowance in the development of the interval training for not only the length of the traveling route and the individual way segments but also the position of the waypoints.

The control mechanism for traveling in curves or for changes of direction at waypoints is described below.

A method for changes of direction at waypoints, given by way of example, is described below.

If the training device approaches a waypoint, the autopilot must then possibly, depending on the position of the waypoint following thereafter, carry out a directional correction. The future traveling direction of the training device is obtained from the position of the waypoint headed for at the present time and the waypoint following thereafter. It is calculated from the coordinates of these two points on the basis of the method described above for the calculation of the course angle along an orthodrome.

Since great, abrupt changes of direction at a fixed speed may lead to an unstable position of the training device, and possibly also adversely affect the training session, a curve radius $r_{min}$ and a curve speed $v_{max}$ are fixed, and when there is a change of direction the values must not go below or exceed these values.

The interrelationship between the minimum or maximum value for the curve radius, steering angle and curve speed may be determined analytically by using the physical formulas for centrifugal force and static frictional force on the basis of variables such as the mass of the vehicle, condition of the roadway and coefficient of static friction. However, since the condition of the roadway and the static frictional forces may vary to a great extent, alternatively the maximum curve speed $v_{max}$ for a given curve radius r and steering angle $\phi$, or the minimum curve radius $r_{min}$ and maximum steering angle $\phi_{min}$ for a given curve speed may be determined empirically and stored in a table, which the control accesses.

Figure 18:
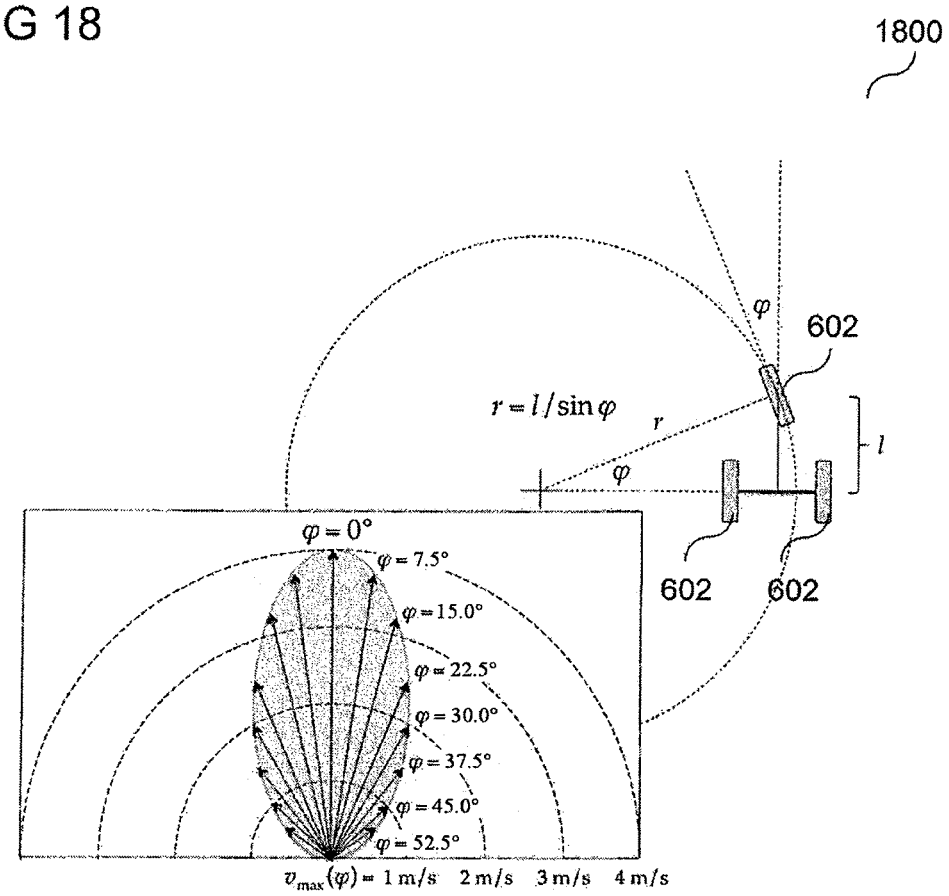
FIG. 18 illustrates the relationship between the steering angle and the maximum speed according to an embodiment.

FIG. 18 illustrates the interrelationship between the steering angle and the maximum speed according to an embodiment. FIG. 18 contains a graphic representation 1800 of the relationship between the speed and the admissible steering angle.

Figure 19:
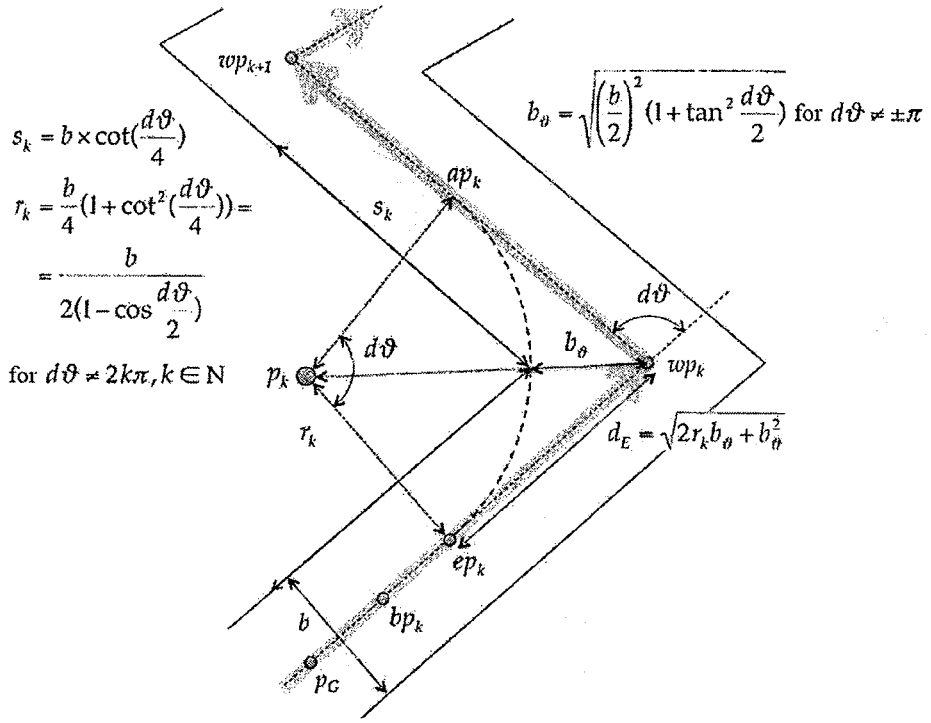
FIG. 19 illustrates traveling in a curve according to an embodiment.

The control for the change of direction at a waypoint and the traveling in a curve is influenced by the following variables, as represented in FIG. 19 and the illustration 1900 of traveling in a curve:

- the minimum roadway width b along the entire traveling route; for example, if the width of the roadway in the traveling direction is considered, the width of the entire way or the entire road is then 2b;
- it is not absolutely necessary that b corresponds to the actual physical width of the roadway; it is also possible to assume a virtual roadway width, which marks a virtual corridor on either side of the connecting line between two successive waypoints; this corridor may be much narrower than the actual roadway width;
- current position of the training device $p_G$;
- distance of the vehicle from the waypoint headed for $d(p_G, wp_k)$;
- position of the waypoint headed for $wp_k$ and the next waypoint $wp_{k+1}$;
- momentary traveling direction and future traveling direction $\theta_k$ and $\theta_{k+1}$ and the angle lying in between $d\theta$ (modulo 360°);
- present speed of the training device $v_m$ and the maximum curve speed $v_k$ in dependence on the associated curve radius $r_k$;
- maximum deceleration $a^-_G$ and maximum acceleration $_a+_G$ of the device;
- center point $p_k$ and radius $r_k$ of the turning circle at waypoint $wp_k$;
- turning-in point $ep_k$, the point at which the control begins the change of direction, and turning-out point $ap_k$, the point at which the training device ends the traveling in a curve; and
- braking point $bp_k$, the point along the distance $<p_G, wp_k>$ from which the vehicle can be braked at maximum deceleration to a speed that allows a safe change of direction within the travelway.

From the travelway width b and the momentary position of the device $p_G$, the position of the waypoints $wp_k$ and $wp_{k+1}$ and the angle between $<p_G, wp_k>$ and $<wp_k, wp_{k+1}>$, the control computer initially calculates an arc of a circle with the center point $p_k$ and radius $r_k$, on which the training device can safely perform a change of curve without leaving the roadway.

From the aforementioned table, the control computer then determines the maximum curve speed $v_k$ for this radius that must not be exceeded on the arc in order not to bring the device into an unstable position.

Furthermore, the control computer calculates the turning-in point $ep_k$, at which the change of direction is begun; $ep_k$ is the point between $p_G$ and $wp_k$ that lies at a distance of $d_E$ from $wp_k$, where $$d_E = \sqrt{2r_k b_\vartheta + b_\vartheta^2} \text{ with } b_\vartheta = \sqrt{\left(\frac{b}{2}\right)^2\left(1 + \tan^2\frac{d\vartheta}{2}\right)}$$

The turning-out point $ap_k$ is calculated in an analogous way: the turning-out point $ap_k$, at which the change of direction is ended, is the point between $wp_k$ and $wp_{k+1}$ that lies at a distance $d_E$ from $wp_k$.

For the speed while traveling in a curve, the control computer differentiates between two cases:

Case 1: $v_m \leq v_k$

In this case, the momentary speed is less than the maximum admissible curve speed. The training device can turn into the curve at the turning-in point without reducing the speed, but must not increase the speed in the curve, even if this is possibly specified by the training program. The control computer must perform a corresponding speed limitation.

Case 2: $v_m > v_k$

In this case, the training device must reduce its speed, in order to turn into the curve at the turning-in point at a speed $v_k$. For this purpose, the control computer determines from the maximum deceleration the braking point $bp_k$ from which the training device can be braked to a speed $v_k$ up until the turning-in point $ep_E$.

Once the turning-in point has been reached, the control computer then begins the change of direction that sets the training device in the new traveling direction $<wp_k, wp_{k+1}>$. There are several variants for controlling the traveling in a curve. Two are mentioned below by way of example.

The control computer may divide the arcs for traveling in a curve into multiple segments and introduce what are known as auxiliary waypoints along the arc. The distance between these auxiliary waypoints should be chosen on the one hand to be small enough that a maximum change of direction that would enforce an abrupt change of speed is not exceeded and on the other hand to be large enough that the control responds to the change of direction.

Alternatively, the control computer may determine from the length of the curve that for example a point has to pass over in the traveling direction along the center line of the device the length of the curve for the wheels facing toward and away from the center point of the curve. The control computer can then calculate from the differing length of these curves an individual speed of each wheel of the training device that is valid for the entire travel in a curve. This variant of a solution has the disadvantage that the control computer cannot compensate for unintentional changes of direction that are caused by unevennesses of the roadway.

In any event, while traveling in a curve, the control computer limits the specified speed settings originating from a training program to the maximum admissible curve speed.

Traveling in a curve is ended when the training device has reached the turning-out point (as defined above).

Since abrupt changes of direction and changes of speed are physically impossible, the assumption that the training device moves or can be moved on an exact circular path while traveling in a curve is unrealistic. In road construction, curves therefore generally do not have the form of segments of a circle but are instead described by what are known as clothoids. Clothoids take account of the fact that vehicles cannot change their steering angle abruptly, but continuously. The aforementioned changes of direction are therefore not implemented by the control computer directly and abruptly but only with delays. The training device will therefore only move approximately on a circular path. The deviation from this ideal path depends on the choice of control parameters that the control computer users.

An interaction of the autopilot function and manual control according to an embodiment is described below.

The interaction of the autopilot function and manual control does not differ significantly from the interaction with control by the training program. One difference is that the user can change the speed at any time, either directly or by changing the setpoint value for the physiological parameter. This allows the user to change the speed at his own discretion, even while traveling in a curve.

However, in a manner similar to the program-controlled speed control, the autopilot will set an upper limit for the curve speed. Should the user attempt to increase the speed while traveling in a curve, this would remain ineffective. Only as from the turning-out point $ap_k$ can the user again increase the speed freely as desired.

Activating, interrupting and ending the autopilot function according to an embodiment is described below.

In the case of a device with an autopilot function, after switching on the device there additionally appears on the input/output unit an "autopilot" button. If the user activates this button, he is initially also asked whether he would like manual control of the training device or would like to run a training program.

In dependence on this decision, the user is then given the possibility of selecting from several routes. In the choice of a training program, the routes may be stored with a training profile. If the user chooses manual control, he must control the speed manually, as described above.

However, in both cases only routes of which the starting positions do not exceed a specified distance from the momentary position of the training device are available to choose. After selection of the route, the user returns to the main menu of the control and can start the training device. Before the device is started, it should be aligned approximately in the direction of the first waypoint, since otherwise very abrupt and undesired movements may occur.

The travel of the training vehicle from the location where it is switched on to the first waypoint of the training route is not regarded as constituting part of the training travel session. It is performed at a very moderate speed set to a fixed value.

The user can interrupt the training travel session by autopilot at any time, by activating the "interrupt" button. In this case, the speed is reduced to zero and the training vehicle is stopped.

In order to move the vehicle manually, the user must additionally activate the "release brakes" button. This appears on the input/output unit directly after activation of the "interrupt" button. With the motor brakes released, the user can move the training vehicle freely as desired. He can push it by physical force further along the roadway or he can push it around an obstacle.

In order to continue the training travel session, the user must activate the "continue" button. Before the training device continues its travel in the autopilot mode, it checks its position along the training route. If the device is further away from the connecting line between two waypoints by more than half a way width b/2, the journey cannot be continued in autopilot mode. The activation of the "continue" button remains ineffective. If the device is away from the connecting line between two waypoints by half a way width b/2 or less, the control computer then selects the waypoint closest to the final target and heads for it as the next intermediate target. The training program is continued from where it was interrupted.

If the "autopilot" button is not activated, the device is then operated as described further above.

A device configuration with automatic collision avoidance according to an embodiment is described below.

In the case of the configuration with automatic collision avoidance, the training device has in addition to the autopilot function a sensor configuration that allows the detection of obstacles on the roadway and automatic diversion and avoidance of these obstacles.

The training device may include a sensor configuration ("obstacle sensor") 806, including one or more distance sensors, which produce 2D or 3D distance measurements, for detecting obstacles above the roadway and for measuring the distance between the obstacles and the training vehicle, combined with sensors for sensing the rotation of the training vehicle or the obstacle sensor about its principal axes.

An obstacle detection and creation of two-dimensional local grid maps according to an embodiment is described below.

Objects which are of a height above the roadway that exceeds the ground clearance of the training vehicle and protrude partially or entirely into the travelway of the training device, and therefore would lead to a collision with the vehicle when traveling in the desired direction, are regarded as obstacles.

Distance-measuring 2D or 3D sensors are used for detecting such objects. Sensors that have a range within which the training vehicle at maximum speed and with maximum deceleration can be brought to a standstill before an object are used. The distance-measuring sensors are attached to the training vehicle such that their sensing range covers the space on the travelway that the vehicle can move into from the present position with all the allowed changes of direction.

Depending on the sensor modality and resolution used, the sensors produce a 2D or 3D distance profile of the roadway located ahead of the vehicle and the obstacles on it. If the sensors and the sensor images generated from their data produce a 3D distance profile of sufficient resolution, a height profile of the obstacle together with its lateral and longitudinal spatial extent ahead of the training vehicle can be calculated.

If 2D distance sensors are used, it may be difficult and expensive to obtain three-dimensional information about the space in the area in front of the vehicle from the sensor images. In this case, the information important for obstacle avoidance can be determined implicitly by using the positioning and alignment of the sensors on the training vehicle, and consequently by using the sensor range. For example, ultrasonic sensors may be aligned such that they can only perceive obstacles, and produce a corresponding sound reflection, if the obstacle exceeds a minimum height, which can be set to a fixed value.

In order to be able to make allowance for changes of position of the sensors and the associated changes in the sensor images, one or more position sensors are used. The measured values of these position sensors are linked with the sensor images of the distance values, so that the sensor images can be brought into correlation with one another by using a coordinate transformation corresponding to the change of position.

Since an individual, momentary sensor recording may possibly contain degraded or even incorrect measured values, a reliable replication of the surroundings of the training vehicle can be determined by correspondingly superposing and fusing multiple sensor recordings. Degraded or erroneous measurements can in this way be filtered.

Figure 20:
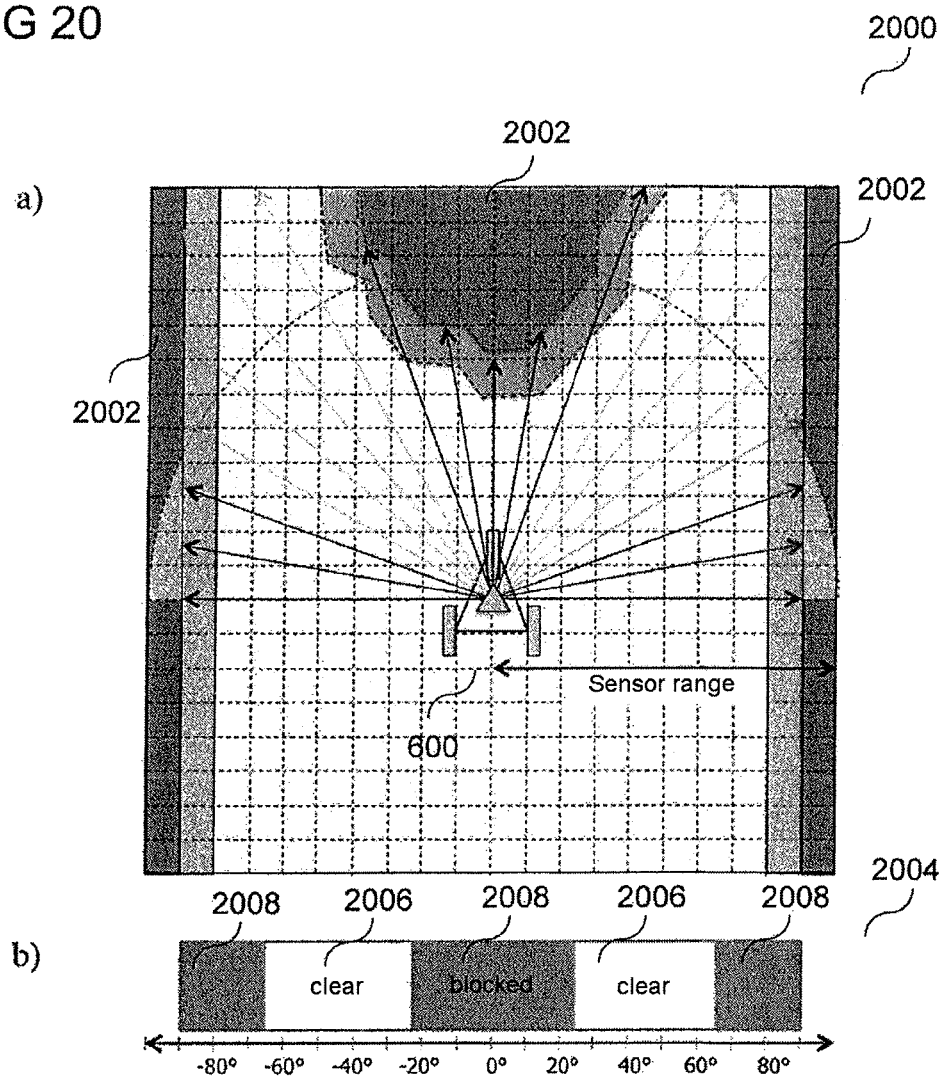
FIG. 20 shows in a) a projection of sensor data into a grid (local map) and in b) a one-dimensional obstacle map in polar coordinates as a polar obstacle image according to an embodiment, angular areas that are marked in gray corresponding to obstacles.

FIG. 20 shows in a) a projection 2000 of sensor data into a grid (local map) and in b) a one-dimensional obstacle map 2004 in polar coordinates as a polar obstacle image of obstacles 2002 according to an embodiment, angular areas 2008 that are marked in gray corresponding to obstacles and white angular areas 2006 corresponding to areas that are clear.

According to an embodiment, a discretized representation is chosen for the filtering and fusing of momentary sensor recordings. In this case, the measurement data of the distance sensors, which are often given in polar coordinates, are projected into a two-dimensional grid map (as shown in FIG. 20*a*)). The grid map may be referred to as "occupancy grids". In this case, for each cell of the grid there is a corresponding square of space of a certain edge length in the real world, and vice versa. The reference point for such a "local map", as it is known, is a reference point on the training vehicle.

Since the sensor data corresponds to the measured distance between the training vehicle and an object, the projection of one or more distance values into the grid representation marks the position of the object in relation to the training vehicle. A cell marked in the grid representation is accordingly referred to as occupied.

During the travel, the local map is updated at close regular intervals, in order always to have available an authentic representation of the surroundings of the training vehicle and any obstacles for the calculation of the course or possibly the diversionary course.

The delimitations of the roadway are inserted into the grid map as virtual obstacles. For this purpose, the connecting line between the waypoints that delimit the way segment being traveled along at the time is projected into the local grid representation. After that, each cell in the grid at a distance perpendicularly to this virtual line that is greater than half the width b/2 of the instantaneous way segment is marked as occupied by an obstacle. Inserting the roadway delimitation as a virtual obstacle prevents the vehicle from veering off the roadway during the diversionary movement.

The grid map may be modified by a method that can be referred to as "obstacle growing" such that allowance is made for the physical extent of the training vehicle when collision-free courses are calculated in a step described further below.

Automatic collision avoidance according to an embodiment is described below.

According to an embodiment, a method that can calculate setpoint variables for the traveling direction and speed for a collision-free advancement in the direction of the target from a two-dimensional grid map, as was described above, can be used.

According to an embodiment, a method by which a one-dimensional "polar obstacle image" (polar histogram), as it is known, is determined from a grid map can be used. This polar obstacle image gives information about in which traveling direction (and at what distance), with respect to the momentary location of the vehicle, an obstacle that cannot be overcome by the vehicle is located. In FIG. 20 *b*), such areas are marked as "clear" and "blocked".

On the basis of the aforementioned obstacle growing, the polar obstacle image already makes allowance for the lateral extent of the training vehicle and only declares those traveling directions in which the vehicle has sufficient lateral clearance from the nearest obstacle, and can safely pass it, to be obstacle-free.

If one or more obstacles are detected in the polar obstacle image, the control computer then determines all obstacle-free traveling directions that do not lead to a collision with an obstacle. From the obstacle-free traveling directions determined, the control computer then selects the one that requires the smallest change of direction with respect to the original traveling direction to the next waypoint and controls in this direction.

If the calculated smallest change of direction is not clear, since the required change of direction to the left (traveling past the obstacle on the left) is equal to the required change of direction to the right (traveling past the obstacle on the right), the change of direction to the right is given preference ("rule of passing on the right").

In dependence on the obstacle density and the distance from the training vehicle, under some circumstances the speed specified by the user or training program must be reduced. The aforementioned methods include methods of calculation to calculate a reduced speed that is adapted to the obstacle situation.

Should the control computer not be able to determine any obstacle-free traveling direction in the obstacle image, for example because the complete roadway is blocked, the control computer then decelerates/brakes the training vehicle such that it can be brought to a standstill before the obstacle without a collision and goes into the interruption mode. By releasing the brakes, the user can then shift the position of the vehicle before continuing.

The creation of the polar obstacle image from the 2D or 3D distance images and the determination of a collision-free course is embedded in a control loop, which the control computer performs with a cycle time of, for example, several tens of Hertz.

A return to the original route after a diversion according to an embodiment is described below.

After passing an obstacle (i.e. apart from the roadway delimitation, no obstacles are detected), the automatic direction control and collision avoidance would have the effect that the training device would move again on a direct course in the direction of the next waypoint. On account of the preceding diversionary movement, the training device would in this case be moving on a different courseline than the originally planned courseline between $<wp_{k-1}, wp_k>$. Under some circumstances, however, it is desirable that, after the diversion, the training device reverts to the originally planned courseline $<wp_{k-1}, wp_k>$ as quickly as possible.

Figure 21:
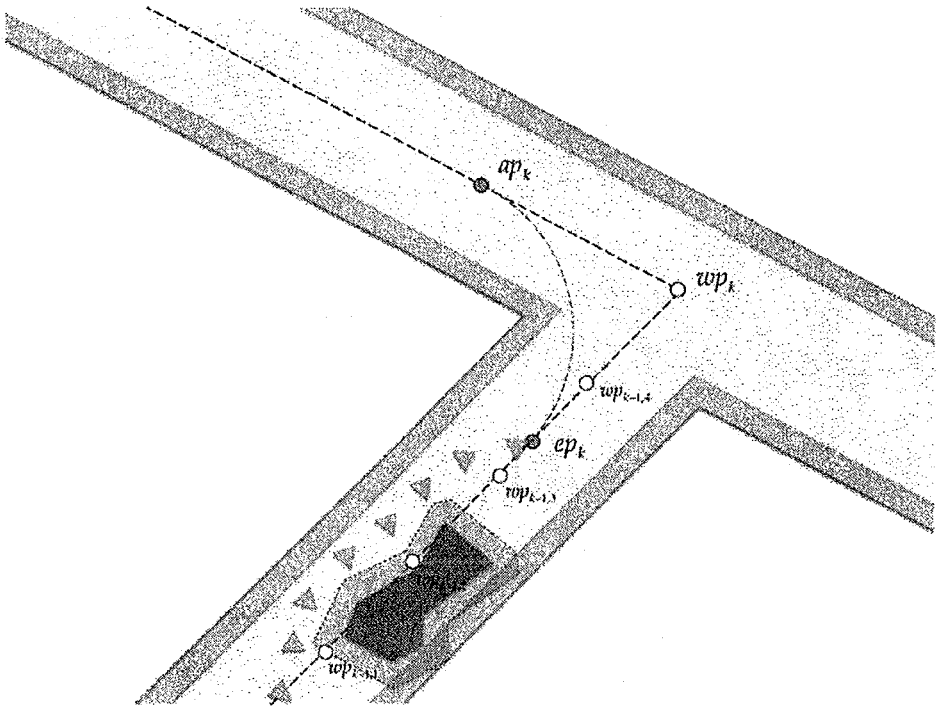
FIG. 21 illustrates diversionary travel according to an embodiment.

This can be achieved for example by introducing additional auxiliary waypoints $wp_{k-1,1}, \ldots wp_{k-1,n}$ between $wp_{k-1}$ and $wp_k$ by repeatedly dividing up the route. The control computer then does not select $wp_k$ as the next waypoint to be headed for, but the auxiliary waypoint that is the nearest in the traveling direction, is not blocked by an actual or virtual obstacle and can be reached with a change of direction without reducing the traveling speed, as in the illustration 2100 shown in FIG. 21 of diversionary travel according to an embodiment.

An interaction of traveling in a curve and automatic collision avoidance according to an embodiment is described below.

As long as travel in the direction of the next waypoint is not disturbed by obstacles (and the automatic collision avoidance is active), the control computer controls the training vehicle on the basis of the speed settings specified by the user or the training program directly or indirectly (by using physiological parameters). In a curve, the speed and direction are influenced as described above, in order to ensure safe travel in the curve.

If, however, the training device is in a diversionary movement to avoid a collision, and thereby passes the next turning-in point $ep_k$ and approaches the waypoint $wp_k$, regular travel in a curve cannot then be initiated and carried out on the basis of the course calculation described above.

In this situation, the control of the training vehicle is taken over completely by the automatic collision avoidance. This receives as the target the next waypoint $wp_{k+1}$ and as the desired speed the speed for this new way segment that is specified by the user or the training program.

The methods mentioned and described above are used to calculate from this a collision-free traveling direction and safe speed that control the training vehicle in the direction $wp_{k+1}$.

According to an embodiment, a modular device configuration for mounting on children's buggies or walking aids may be provided, for example in the form of an attachment set as described above.

The modular device configuration differs from the device configurations described above in that it is not constructed on a vehicle of its own, but instead components of these device configurations are merely integrated in existing vehicles (carrier vehicle), which do not primarily have the character of training devices but can be modified into such devices. Examples are sport strollers or baby joggers, golf trolleys, or walking and running aids.

In the basic version, this device configuration merely comprises the drive unit 708, the control unit 710, the input/output unit 712, the sensor or sensors for physiological parameters 818, the safety device 714 and their respective subcomponents.

On the basis of the basic version, each of the device configurations described above can also be constructed in a modular form. In addition to the aforementioned components for the basic version, according to various embodiments the corresponding additional components may be provided for the respective device configuration.

The modular device configurations may include as additional components suitable mountings for the aforementioned components for the drive, control, input/output and safety device and/or mechanical devices for the power transmission from the modular drive to one or more wheels of the respective carrier vehicle.

A mechanical structure and devices for power transmission according to various embodiments are described below.

The aforementioned components for the drive, control, input/output and safety device are fastened to the carrier vehicle by means of suitable mountings suitably designed for the construction and design of the intended vehicle. The components themselves do not have to be modified for this. According to various embodiments, suitable mountings can be provided.

Figure 22:
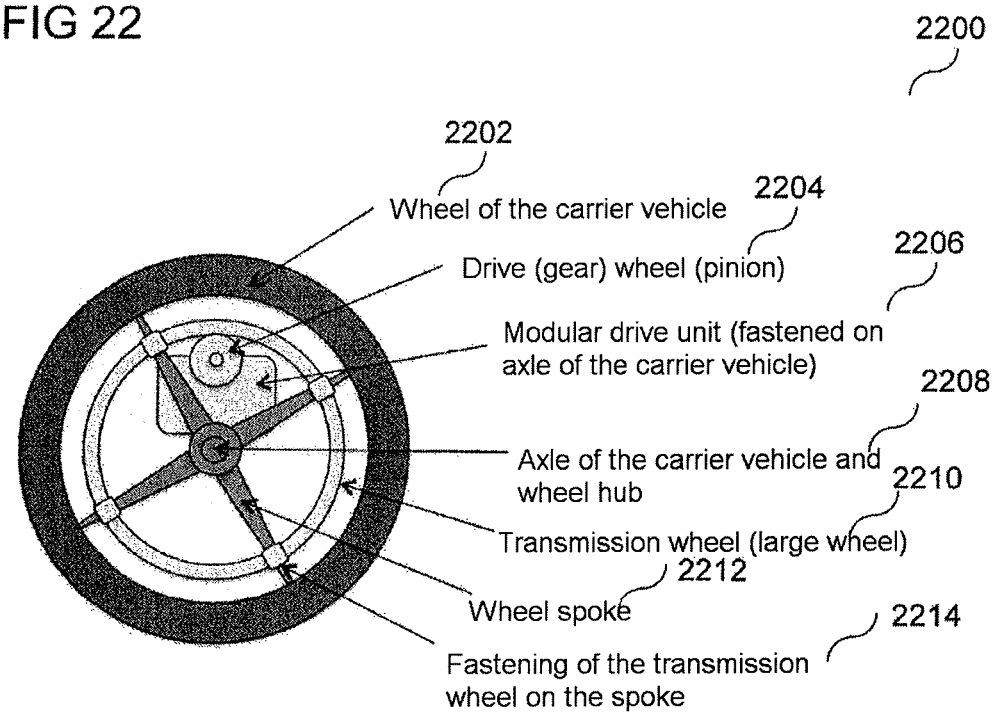
FIG. 22 shows modular drive according to an embodiment.

FIG. 22 shows a modular drive 2200 according to an embodiment.

In the device shown for the power transmission from a modular drive unit to the wheels of a carrier vehicle, a transmission wheel (large wheel) 2210 can be fastened concentrically about the axle 2208 of the carrier vehicle to the spokes 2212 of the carrier vehicle by means of a fastening 2214 (for example by means of a clamping-screwing device). This large wheel is generally configured as a gear wheel. With the aid of further clamping-screwing devices, one or more modular drive units 2206 are connected to the axle or axles and further elements of the chassis of the carrier vehicle in a rigid and torsion-free manner. The connection is adjusted in such a manner that a drive (gear) wheel (pinion) 2204 has interlocking contact with the transmission wheel and a rotational movement of the drive gear wheel is transferred to the transmission wheel, and consequently to the wheel or wheels 2202 of the carrier vehicle, and brings about a rotation of the same.

The interconnection and interaction of the components for the drive, control, input/output and safety device is analogous to the interconnection and interaction of the components for the non-modular device configurations.

The creation of training programs according to various embodiments is described below.

Training programs may be sequences of individual training activities. A distinction can be made between two training activities: running at a certain, constant speed with a variable progression of physiological characteristics, such as heart rate or respiration rate; running with a certain constant exertion (constant progression of physiological characteristics) at a variable speed.

According to various embodiments, these activities can be pursued for a certain time interval or over a certain distance. This form of training programs is entirely independent of the geographical conditions in which the programs are performed. They can consequently be performed at any place and any possible training route, as long as the training device can travel over it.

Alternatively, training programs may also be related to local conditions. Thus, for example, a training activity may relate to two waypoints, a starting point and a finishing point. Location-dependent training programs support the autopilot function, but have the disadvantage that they cannot be performed at any other location or on any other training route.

Location-independent training programs for devices without an autopilot function according to various embodiments are described below.

A data structure for training programs is described below.

Figure 12:
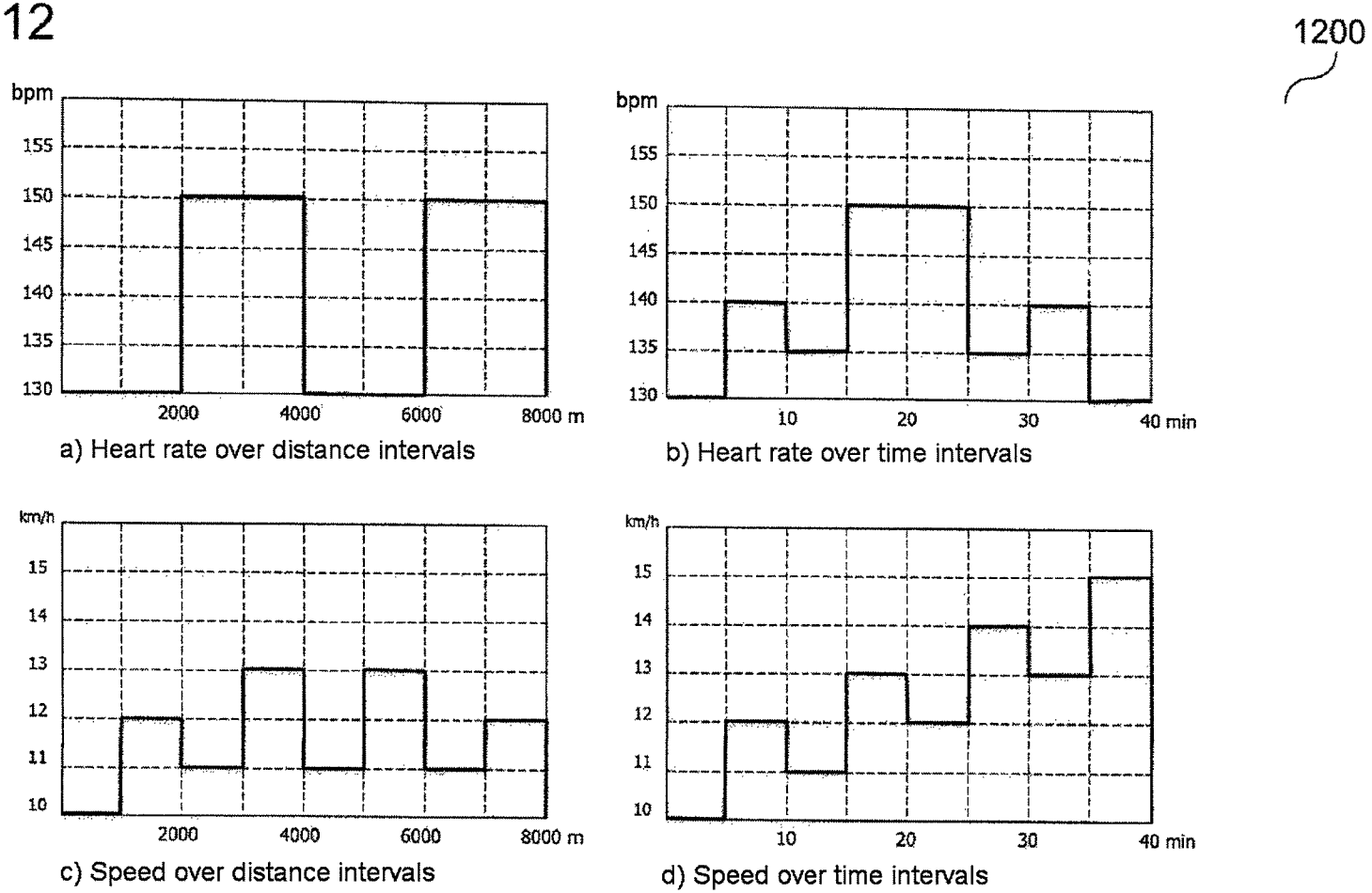
FIG. 12 shows examples of training programs according to various embodiments.

An example of an activity sequence is shown in FIG. 12. FIG. 12 *a*) shows a training program for interval training, in which the user first runs 2000 meters at a heart rate (HR) of 130 beats per minute (bpm), then a further 2000 meters at a heart rate of 150 bpm. As shown in FIG. 12 *b*), the heart rate may also be specified over a time interval. The change between an exertion of 130 bpm and 150 bmp is repeated over the following 4000 meters. FIG. 12 *c*) shows a training program in which the running speed is varied at intervals of 2000 meters (tempolauf). As shown in FIG. 12 *d*), the speed may also be specified over a time interval.

In order that they can be processed by the control computer of the training device, training programs must conform to a specific data format or a specific structure. A data structure given by way of example is described below. This data structure given by way of example consists of a series of pairs of values prefixed by a key pair, which describes the size units of the pairs of values. The first element fixes the type of interval or duration for which the setpoint variable is intended to apply, for example distance (measured in meters) or time (measured in seconds). The second element of the key pair fixes the type of setpoint variable for the control, for example speed (measured in km/h) or heart rate (measured in bpm).

The key pair is followed by a sequence of pairs of values which then fix the duration and the value of the setpoint variable.

An example may look as follows:

<<D (m), HR (bpm)>: <2000, 130>, <2000, 150>, <2000, 130>, <2000, 150>>

A creation of programs according to various embodiments is described below.

Two tools with the aid of which location-independent training programs can be created and edited are described by way of example. These tools are intended for vehicles without an autopilot function or for operation without an autopilot. The tools may be operated both on the control computer and on some other computer. In the first case, the training programs are stored as a file by the control computer in a specific memory area for training programs. In the second case, the training programs must be transferred to the control computer before they are stored in the memory area for training programs.

The first tool is a simple text editor, in which training programs are entered as text in a manner corresponding to the formats described above. The result is stored in a file, which the control computer can load into an internal memory area and execute. The file is possibly also encrypted and converted into binary code before it is transferred to the control computer for processing. The advantage of the use of text editors is that they are very universal and entirely independent of the formats used. However, they have the disadvantage that entries are not necessarily linked with a visual interpretation of the data, and there is therefore no visual plausibility check. Therefore, under some circumstances input errors only become noticeable at the time of execution.

Figure 23:
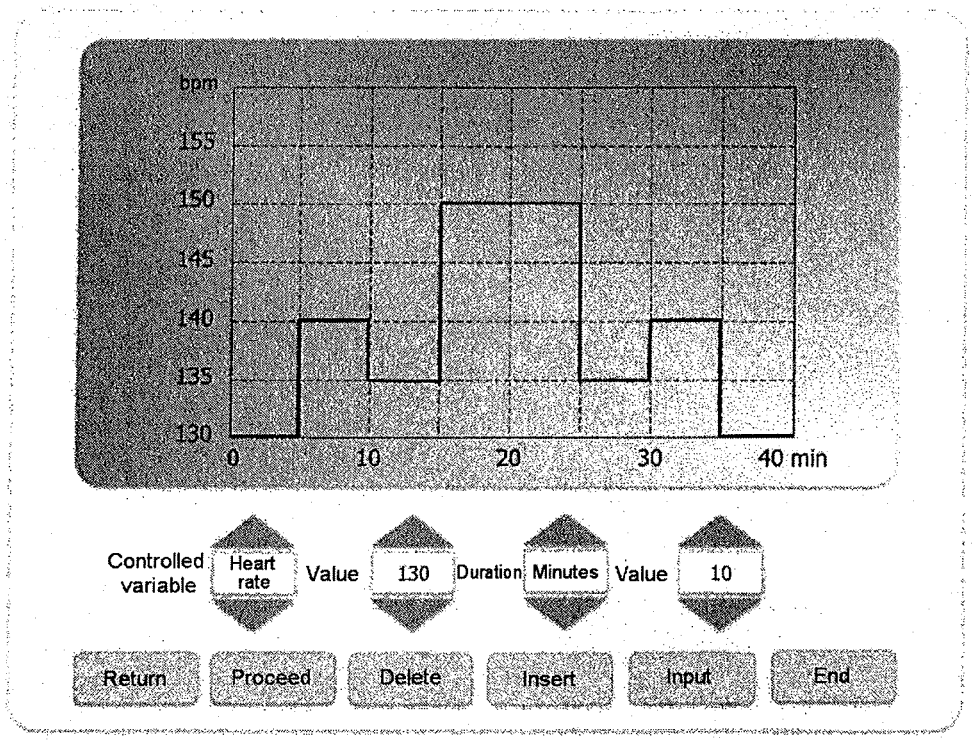
FIG. 23 illustrates a creation of location-independent training programs according to an embodiment.

FIG. 23 illustrates a creation of location-independent training programs according to an embodiment.

These disadvantages can be avoided by use of what are known as graphic user interfaces or graphic input/output devices, possibly with animated control panels. Such a graphic input/output device based on a touchpanel 2300 is shown by way of example in FIG. 23. This input/output device has 14 buttons for input, eight of which consist of arrows which, when activated, have the effect of incrementing or decrementing the input value. Alternatively, instead of the arrow-shaped buttons, and the output area lying in between, graphically animated thumbwheels may be used. The "input" button confirms the values set for a training activity as the final input and advances to the input of the next training activity. The "end" button ends the input of the training program and stores it. The "return" and "proceed" buttons allow scrolling forward and back to training activities that have already been entered. The "insert" and "delete" buttons allow the insertion and deletion of training activities into or from the training program already created. The graphic input/output device also has five graphic output areas, four of which serve for displaying the actual values of a training activity, type of controlled variable, value thereof, type of duration and value thereof. As long as the "input" button has not been actuated, these values can be incremented or decremented by means of the arrow-shaped buttons lying above and below them. In a large output area, the training program is represented as a curve. This graphic representation allows the rapid detection of inconsistencies or errors in the training program. After completion of the training program, it is possibly also encrypted and converted into binary code by the graphic input/output device and stored in a file.

Location-dependent training programs for devices with an autopilot function according to various embodiments are described below.

A possible data structure for location-dependent autopilot-suitable training programs does not differ fundamentally from the data structure for location-independent training programs. It is merely that the key element "duration", measured either as time or as distance, is replaced in it by the "way segment" element WS.

A way segment consists of two waypoints $wp_k$ and $wp_{k+1}$, which mark the beginning and end of the way segment, and the roadway width b of the way segment.

Waypoints are usually characterized by their geographical longitude and latitude. Accordingly, when using decimal notation with algebraic signs, a waypoint is described as a pair of real-value numbers.

An example may look as follows:

<<WS (wp,wp,b), HR (bpm)>:

<((48.043458; 10.912111), (48.041764; 10.911669), 3), 130>,

<((48.041764; 10.911669), (48.041767; 10.909133), 3), 150>,

<((48.041767; 10.909133), (48.041692; 10.908969), 3), 130>,

<((48.041692; 10.908969), (48.041772; 10.906078), 4), 150>>

A location-dependent training program can only be performed when the training program is at the beginning of a way segment, for example at the beginning of the first way segment.

The above format has a certain redundancy, since all of the waypoints apart from two are listed twice, as the end point of the preceding way segment and as the starting point of the following way segment. This redundancy can be eliminated if the plausible assumption is made that the last waypoint of a way segment is the beginning of the way segment then following.

With this simplification, however, there is the problem that the starting point is not well defined in the training program and may be at any point. This problem could be countered by the assumption that the location of the vehicle when the device is switched on is also the first waypoint of the traveling route. However, this would have the undesired consequence that the length of the first way segment is variable and not clearly defined in advance, and consequently also that the training activity cannot be clearly defined in advance.

This problem can be avoided by introducing at the first point in the training program a waypoint that explicitly marks the starting point of the training route. The setpoint variable for the speed control that is combined with this waypoint is ignored however in the performance of the program, since the setpoint variable for the first way segment is defined by the second waypoint. As described above, the training device travels from the location where it is switched on to the first waypoint, the starting point of the training route, at a very moderate speed that can be set to a fixed value.

A further simplification of the format can be achieved if it is assumed that, in the course calculation while traveling in a curve, it is not the individual roadway width of the respective way segment that is used but in all cases the smallest roadway width along the entire traveling route. Although this has the effect that the training device occasionally brakes more than necessary when traveling in curves, it simplifies the course calculation considerably. The above example of a route can consequently be simplified as follows:

<<WS (wp), HR (bpm)>:

<(48.041764; 10.911669), 130>, <(48.041767; 10.909133), 150>,

<(48.041692; 10.908969), 130>, <(48.041772; 10.906078), 150>>

A creation of traveling routes according to an exemplary embodiment is described below.

The fixing or determination (of the coordinates) of the waypoints of a training route can take place in many forms. The user or creator of the program may determine the coordinates of the desired waypoints in a map with sufficient resolution (for example a hiking map) and indications of degrees of longitude and latitude. He may determine them from digital maps. He may explore the traveling route on foot or with a vehicle and determine the coordinates of the waypoints by means of a commonly used portable GPS system. He may record the waypoints and their geographical position by using a recording mode on the control computer during a training travel session and then export them suitably after the training travel session.

When fixing the training route, apart from the geographical coordinates, additional information about the waypoints may be determined or recorded. This may include the roadway width, the elevation of the waypoints above sea level, the distance between two successive waypoints and the direction in which they lie in relation to one another. Although this information is not absolutely necessary for controlling the training vehicle, it may be helpful for the creation of training programs.

An example of geographical properties along the traveling routes are the differences in elevation between two waypoints. The training exertion on an incline is clearly greater than on a flat stretch. Depending on the training effect that is to be achieved, it is advisable to take this into consideration.

Independently of the procedure that is ultimately chosen, it can be assumed that, after fixing of the waypoints, the traveling route is in a readable or exchangeable digital format. An example of such a format is GPX (GPS Exchange Format). This also allows linking of the geographical coordinates (in decimal notation) with additional information. For example, it is usual in GPX for geographical coordinates to be linked with indications of elevation.

A creation of programs according to various embodiments is described below.

In a manner similar to the creation of location-independent training programs, two tools with the aid of which location-dependent training programs can be created and edited are briefly described below by way of example. These are intended for vehicles with an autopilot function or for operation with an autopilot. Both tools must be capable of reading in and further processing traveling routes in a digital format such as GPX. As far as the operation of these tools on the control computer or some other computer and the data transmission are concerned, the same applies as for the tools for location-independent training programs.

A text editor is also the most generally used tool for the creation of location-dependent training programs. The disadvantage of the lack of a visual plausibility check is even greater in the textual acquisition and processing of location-dependent training programs, since greater amounts of data are processed, including in the form of real numbers to six decimal places.

Figure 24:
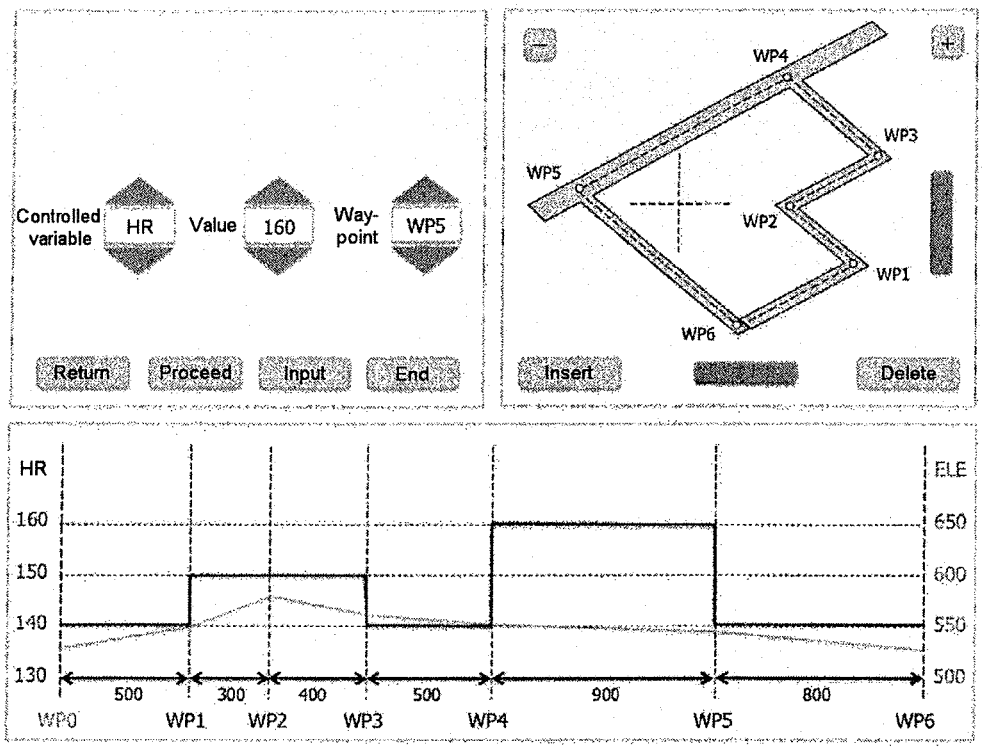
FIG. 24 illustrates a creation of location-dependent training programs according to an embodiment.

FIG. 24 illustrates a creation of location-dependent training programs according to an embodiment.

A graphic input/output device for the creation of location-dependent training programs must link location information and training information in a form that can be clearly viewed. In FIG. 24, a graphic input/output device 2400 with three input/output windows is shown by way of example. The top, left window serves for the input of the training activity. The duration parameter (a training activity in terms of time or distance) is replaced here by the reference to a waypoint. The controlled variable that is set applies from the preceding waypoint to the waypoint which has been set.

As described above, the setpoint variable that is associated with the first waypoint, that is to say the starting point of the route, is ignored. By means of the arrow-shaped buttons or graphically animated thumbwheels, the user can choose or increment or decrement the values for the respective output areas. This also applies in particular to the waypoints read in. The window at the top right contains a two-dimensional view to scale of the position of the waypoints read in. By means of buttons in this window, waypoints can be inserted or deleted. For this purpose, animated knurled screws for horizontal and vertical movement are used to bring a reticle to the point at which a waypoint is to be deleted or inserted, and after that the corresponding button activated. The management of the designations of the waypoints takes place automatically. The scale of the representation can be changed by the buttons with the symbol "+" and "−". The third window shows a linearized representation of the sequence of waypoints in the horizontal axis.

The distance between the waypoints is proportional to their actual Euclidean distance, which is likewise shown in meters on the axis. Over the horizontal axis, two curves are shown by way of example: the curve that represents the controlled variable (HR) for the training program and the curve that represents the progression of the elevation (ELE) along the waypoints.

A web portal for training programs according to various embodiments is described below.

Not only the buildup of a basic level of fitness for amateur athletes but also the achievement of a rehabilitating effect for patients with cardiovascular problems or motor dysfunctions, and the achievement of a clear increase in performance of competitive athletes require careful training planning over a long period of time of weeks and months. It is also essential that the training planning is made to suit the individual physical condition of the person and makes allowance for their present level of performance.

Without such carefully planned training, a contrary, health-impairing effect can easily occur.

In order to counteract the attempt to engage in inexpert training planning and implementation, and a possibly associated risk of health impairment, on the part of the user himself—for example by overexertion—it is advisable that the programs for the training device are based, or even tested on the basis of, sports medicine.

The effectiveness and usefulness of the training device described above will depend greatly on a large number of such tested training programs being available, addressing the individual needs of users and patients and their performance objectives.

This may take place by means of a web portal, in which users of the training device find (location-independent) training programs, which are tailored to specific aspects such as

- age,
- weight/body-mass index,
- gender,
- health risks, disorders and impairments,
- momentary state of fitness and performance,
- desired state of fitness and performance, for example weight loss, basic fitness, competitive objectives (half marathon, marathon, triathlon, etc.), and the like.

Furthermore, by means of such a web portal, tailor-made individual training programs can be made available for users or location-independent training programs can be adapted to local conditions and user-specific requirements.

The following functions may be made available by way of example in such a web portal:

- downloading of prepared training programs (onto a computer/onto a control device);
- searching for programs with specific aspects;
- enquiry for an individualized program on the basis of measured physiological values that have been previously measured or collected; and
- uploading of own training programs.

What is claimed is:

1. A training device, having:

a drive, configured to advance the training device; and a control circuit, having a sensor configured to determine a physiological parameter and the sensor configured to transmit the physiological parameter to the control circuit via an interface configured to receive the physiological parameter of a user of the training device;

wherein the control circuit is configured to specify a speed of the drive on the basis of the physiological parameter received, wherein the control circuit is also configured to specify the speed such that the physiological parameter lies in a specified range, wherein the specified range is variable with a continuing training time and/or is variable with a training distance covered; and wherein the drive is configured to change a direction of advancement of the training device.

2. The training device as claimed in claim 1, wherein the control circuit is also configured to activate the drive according to the specified speed.

3. The training device as claimed in claim 1, wherein the control circuit is also configured to control a specified direction of the training device via the drive to changing the direction of advancement.

4. The training device as claimed in claim 1, also having:

a direction sensor, configured to determine an orientation of the training device.

5. The training device as claimed in claim 1, wherein the control circuit is also configured to specify a specified path of the training device.

6. The training device as claimed in claim 1, wherein the control circuit is also configured to increase the specified speed on the basis of a first specified condition for the physiological parameter received and for reducing the specified speed on the basis of a second specified condition for the physiological parameter received.

7. An attachment set for a training device, having:

a drive, configured to advance the training device;

fastening means, configured to fasten the drive to the training device; and a control circuit, having a sensor configured to determine a physiological parameter and the sensor configured to transmit the physiological parameter to the control circuit via an interface configured to receive the physiological parameter of a user of the training device;

wherein the control circuit is configured to specify a speed of the drive on the basis of the physiological parameter received, wherein the control circuit is also configured to specify the speed such that the physiological parameter lies in a specified range, wherein the specified range is variable with a continuing training time and/or is variable with a training distance covered; and wherein the drive is configured to change a direction of advancement of the training device.

8. The attachment set as claimed in claim 7, wherein the control circuit is also configured to activate the drive according to the specified speed.

9. A control circuit for controlling a training device, the control circuit having:

a sensor configured to determine a physiological parameter and to transmit the physiological parameter to the control circuit via an interface;

the interface configured to receive a physiological parameter of a user of the control circuit;

wherein the control circuit is configured to specify a speed of advancement of the training device on the basis of the physiological parameter received, wherein the control circuit is also configured to specify the speed such that the physiological parameter lies in a specified range, wherein the specified range is variable with a continuing training time and/or is variable with a training distance covered; and wherein the control circuit is configured to control a specified direction of the training device by controlling a drive to change the direction of advancement of the training device.

10. A method for controlling a training device, the method comprising:

receiving a physiological parameter of a user of the training device from a sensor;

specifying a speed of a drive configured to advance the training device on the basis of the physiological parameter received, wherein the speed is specified such that the physiological parameter lies in a specified range, wherein the specified range is variable with a continuing training time and/or is variable with a training distance covered; and activating the drive to change the direction of advancement of the training device.

11. The method as claimed in claim 10, also comprising:

activating the drive according to the specified speed.

12. The method as claimed in claim 10, wherein the drive is activated to change the direction of advancement of the training device according to a specified path.

13. The attachment set as claimed in claim 7, wherein the control circuit is also configured to control a specified direction of the training device via the drive to change the direction of advancement.

14. A training device, having:

a drive, configured to advance the training device; and a control circuit, having a sensor configured to determine a physiological parameter and the sensor configured to transmit the physiological parameter to the control circuit via an interface configured to receive the physiological parameter of a user of the training device;

wherein the control circuit is configured to specify a speed of the drive on the basis of the physiological parameter received, wherein the control circuit is also configured to specify the speed such that the physiological parameter lies in a specified range, wherein the specified range is variable with a continuing training time and/or is variable with a training distance covered; and wherein the drive has a means for changing a direction of advancement of the training device.

15. The training device as claimed in claim 14, wherein the control circuit is also configured to control a specified direction of the training device by means of the means for changing the direction of advancement.

* * * * *